US010433642B2

(12) United States Patent
Schneider

(10) Patent No.: US 10,433,642 B2
(45) Date of Patent: Oct. 8, 2019

(54) CHAIR HAVING A DEFLECTION THAT IS MUTUALLY SYNCHRONOUS BETWEEN BACKREST AND A SEAT

(71) Applicant: Vitra Patente AG, Muttenz (CH)

(72) Inventor: Thomas Schneider, Schwörstadt (DE)

(73) Assignee: VITRA PATENTE AG, Muttenz (CH)

( * ) Notice: Subject to any disclaimer, the term of this patent is extended or adjusted under 35 U.S.C. 154(b) by 217 days.

(21) Appl. No.: 15/512,282

(22) PCT Filed: Sep. 26, 2014

(86) PCT No.: PCT/CH2014/000137

§ 371 (c)(1),
(2) Date: Mar. 17, 2017

(87) PCT Pub. No.: WO2016/044957

PCT Pub. Date: Mar. 31, 2016

(65) Prior Publication Data

US 2017/0245643 A1 Aug. 31, 2017

(51) Int. Cl.
*A47C 1/032* (2006.01)

(52) U.S. Cl.
CPC ..... *A47C 1/03272* (2013.01); *A47C 1/03205* (2013.01); *A47C 1/03255* (2013.01); *A47C 1/03294* (2013.01)

(58) Field of Classification Search
CPC ..... A47C 1/03272; A47C 1/03255; A47C 1/03205; A47C 1/03294
USPC ..... 297/300.5, 302.4, 316
See application file for complete search history.

(56) References Cited

U.S. PATENT DOCUMENTS 4,429,917 A * 2/1984 Diffrient ..... A47C 1/03255 297/300.5
6,644,741 B2 * 11/2003 Nelson ..... A47C 1/03255 297/300.1
7,837,265 B2 * 11/2010 Machael ..... A47C 1/023 297/300.2

(Continued)

FOREIGN PATENT DOCUMENTS

JP 2006-102148 4/2006
JP 2007-135625 6/2007

OTHER PUBLICATIONS

International Search Report dated May 20, 2015 in PCT/CH2014/000137.

*Primary Examiner* — Milton Nelson, Jr.
(74) *Attorney, Agent, or Firm* — Medler Ferro Woodhouse & Mills PLLC

(57) ABSTRACT

A chair is disclosed having a mechanism with a spring unit that permits mutually synchronous deflection between a backrest and a seat over a range between a respective zero position of back and seat inclination and a respective maximum back or seat inclination. Stationary first and second axes of rotation extend through a base support of a carrier unit. A back carrier is articulated on the first axis of rotation, and a third axis of rotation extends through the back carrier. A front of a base plate lies movably on the base support and a rear of the base plate is articulated on the third axis of rotation. The base support has a U-shape with two arms thereof having portions extending upward to engage associated openings in the base plate. When the mechanism is deflected, a relative displacement between the arms and the openings occurs.

15 Claims, 36 Drawing Sheets

(56) References Cited

U.S. PATENT DOCUMENTS

Figure 1C:
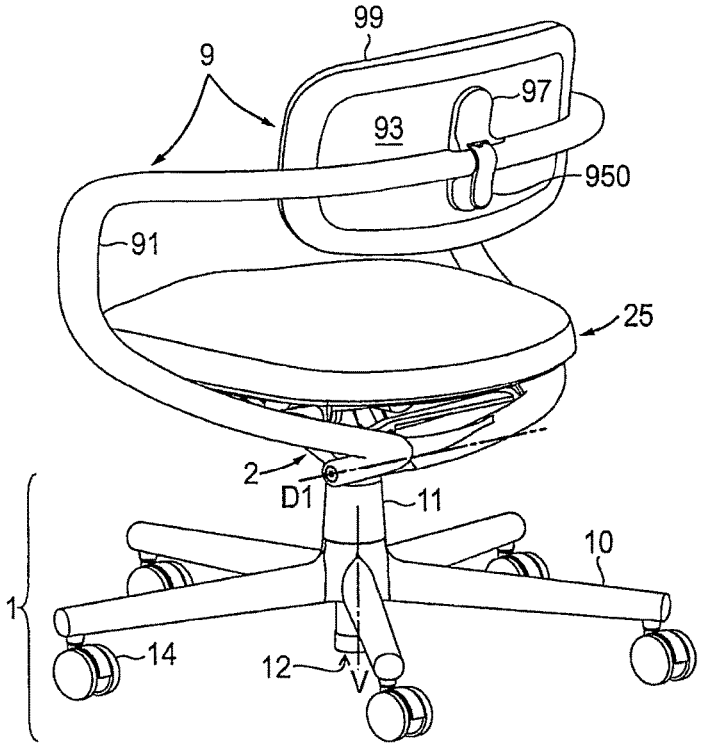

| | | | | |
|---|---|---|---|---|
| 2008/0061614 | A1 | 3/2008 | Masunaga | |
| 2015/0245714 | A1* | 9/2015 | Schneider | A47C 1/03255 297/300.5 |

* cited by examiner

Fig. 1A
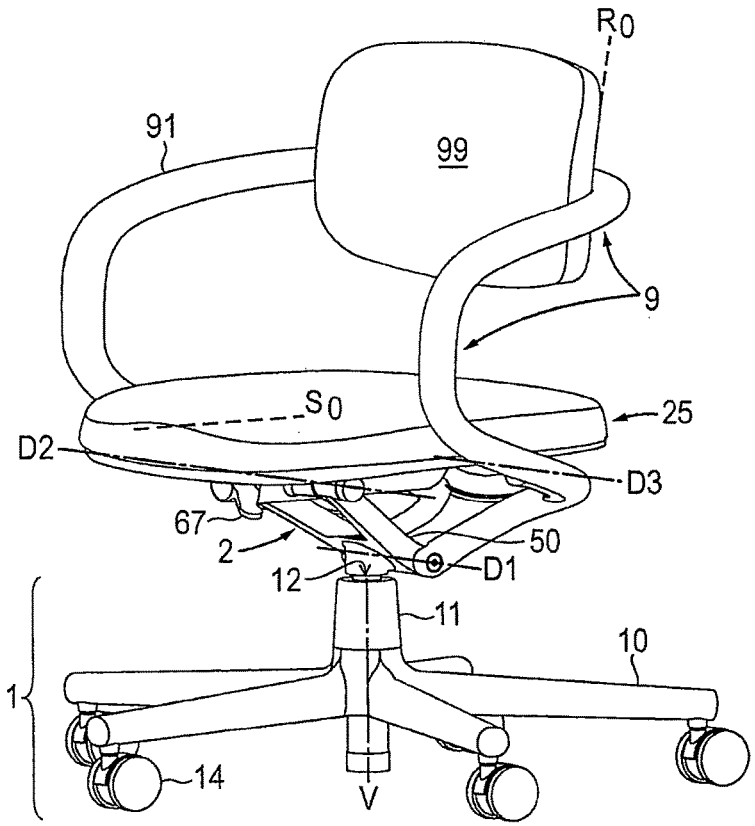
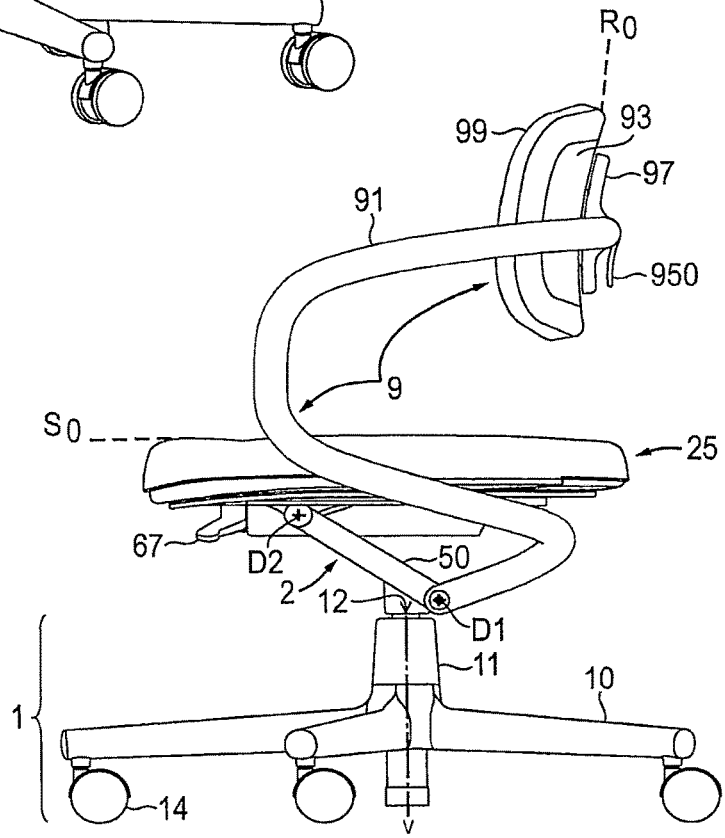
Fig. 1B 38
8
D3
3
30
X3
70
38
309
39
31
71
7
72
X7
6
50
D1
5
20
X5
21
D2

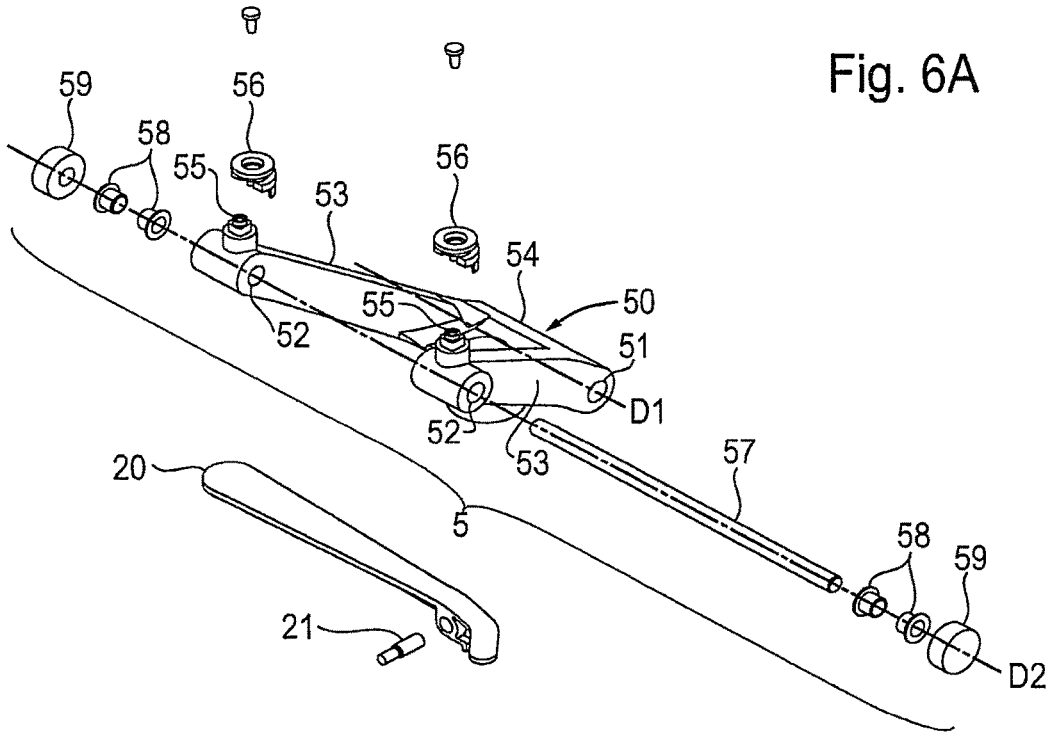
Fig. 6A
Fig. 6B
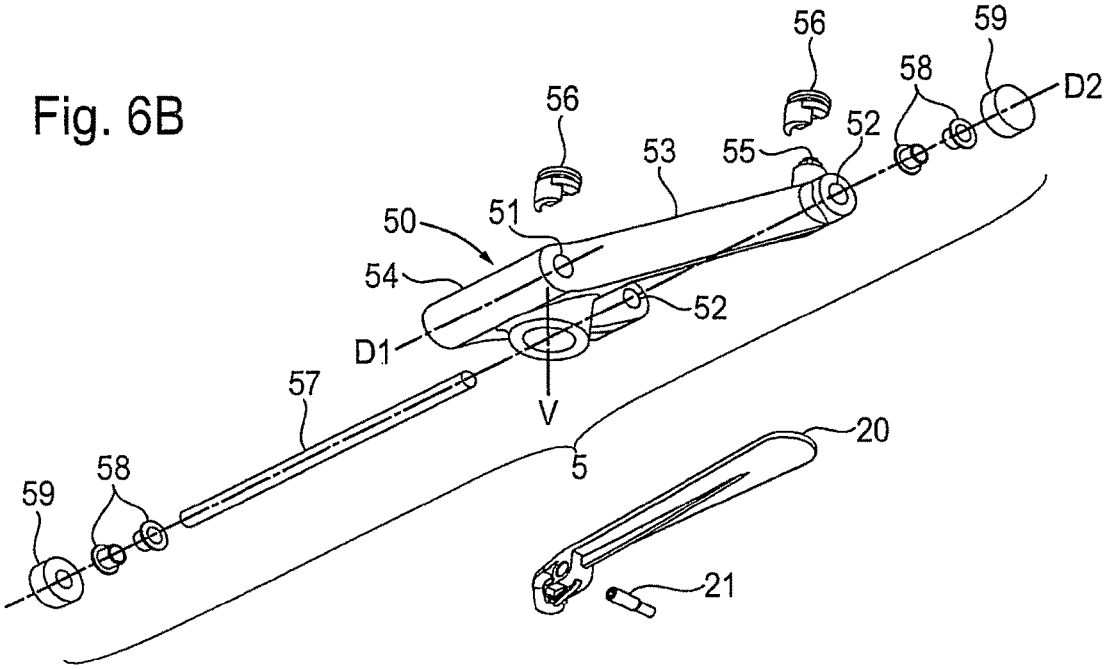

Fig. 7A
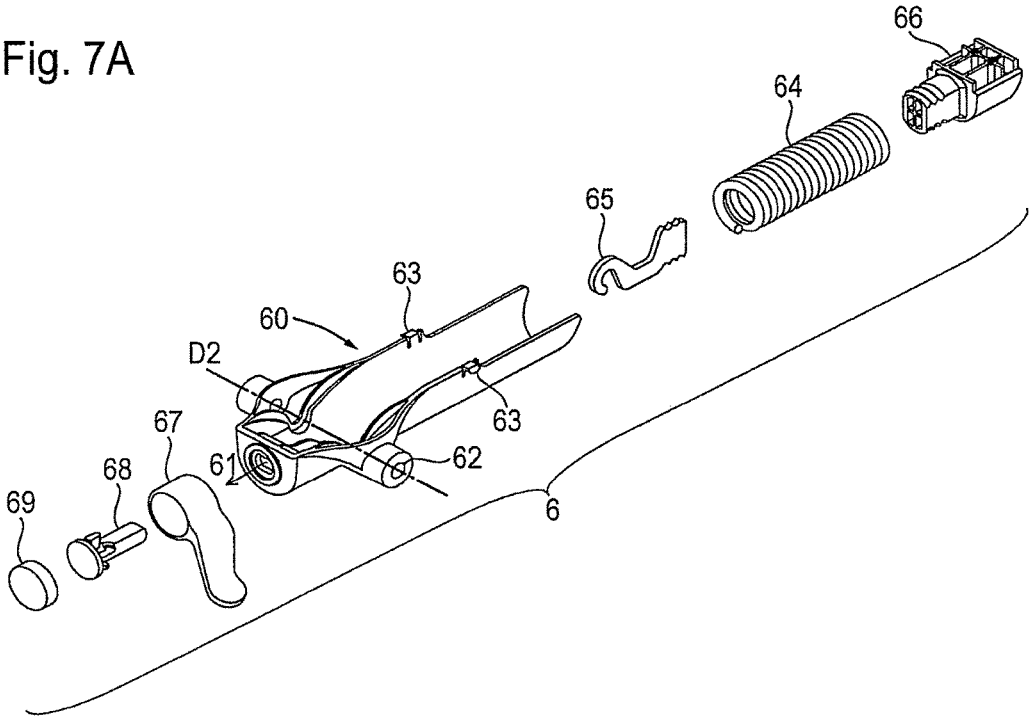
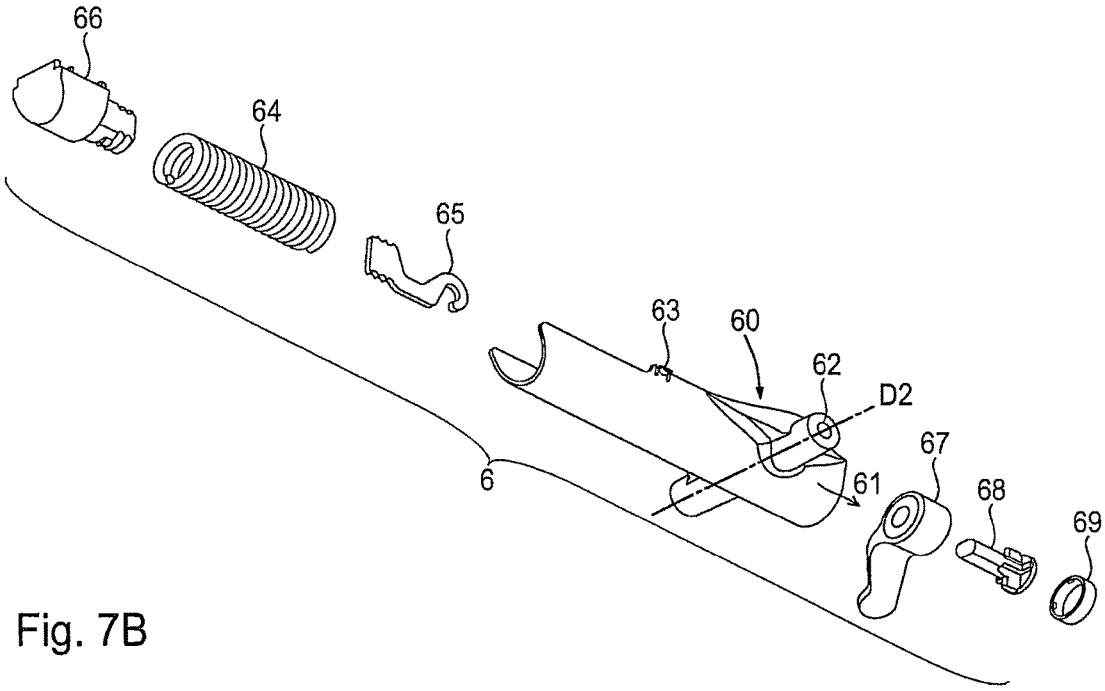
Fig. 7B

Fig. 8A
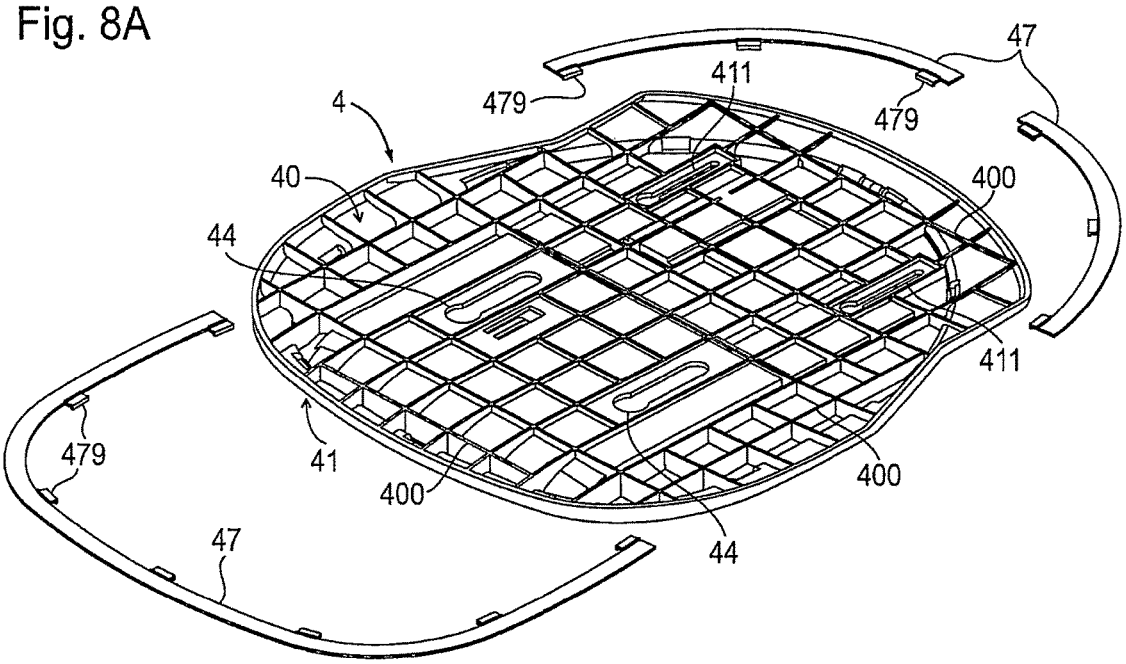
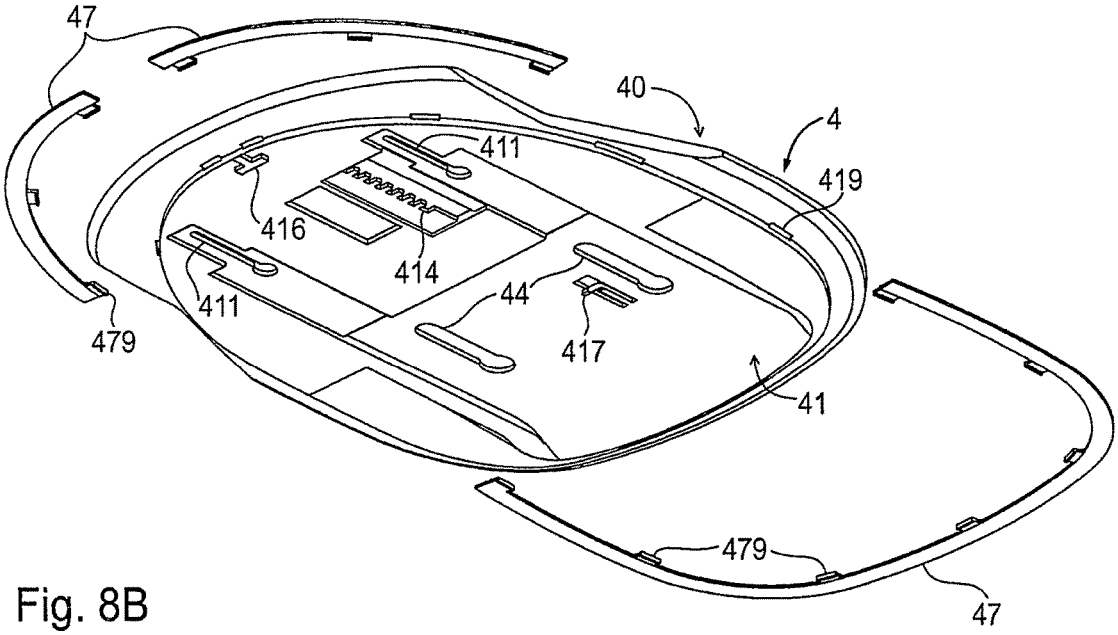
Fig. 8B

Fig. 10E
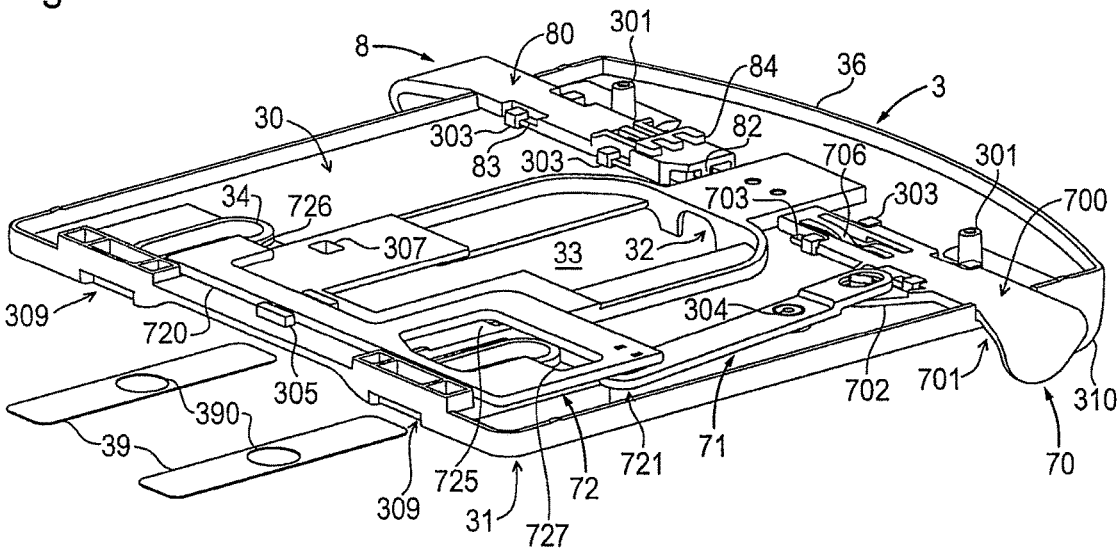
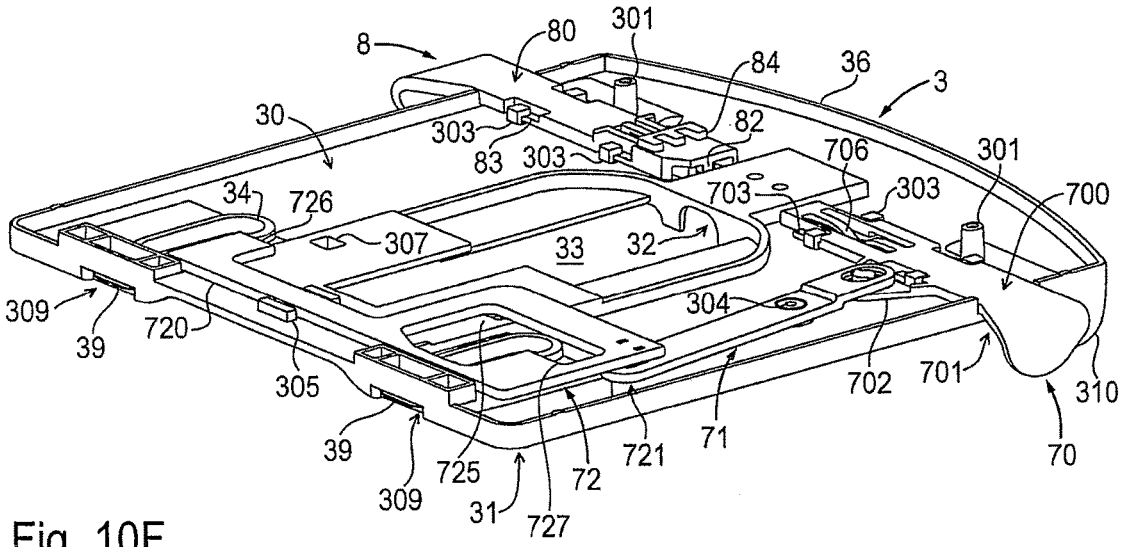
Fig. 10F

Fig. 10G
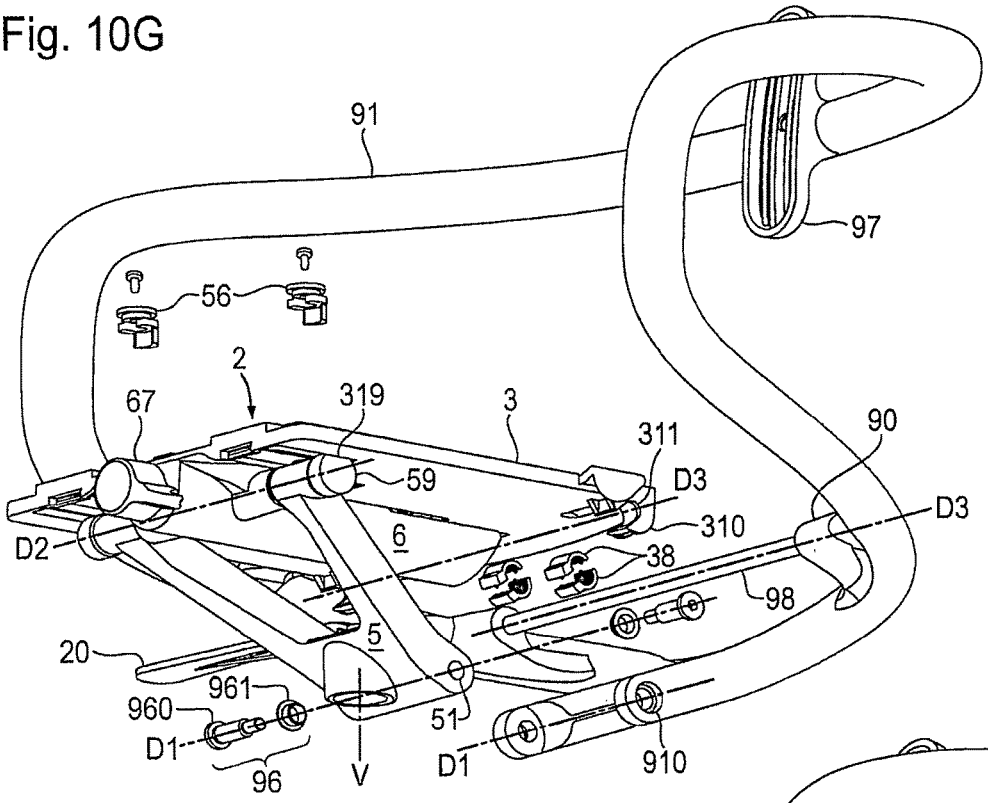
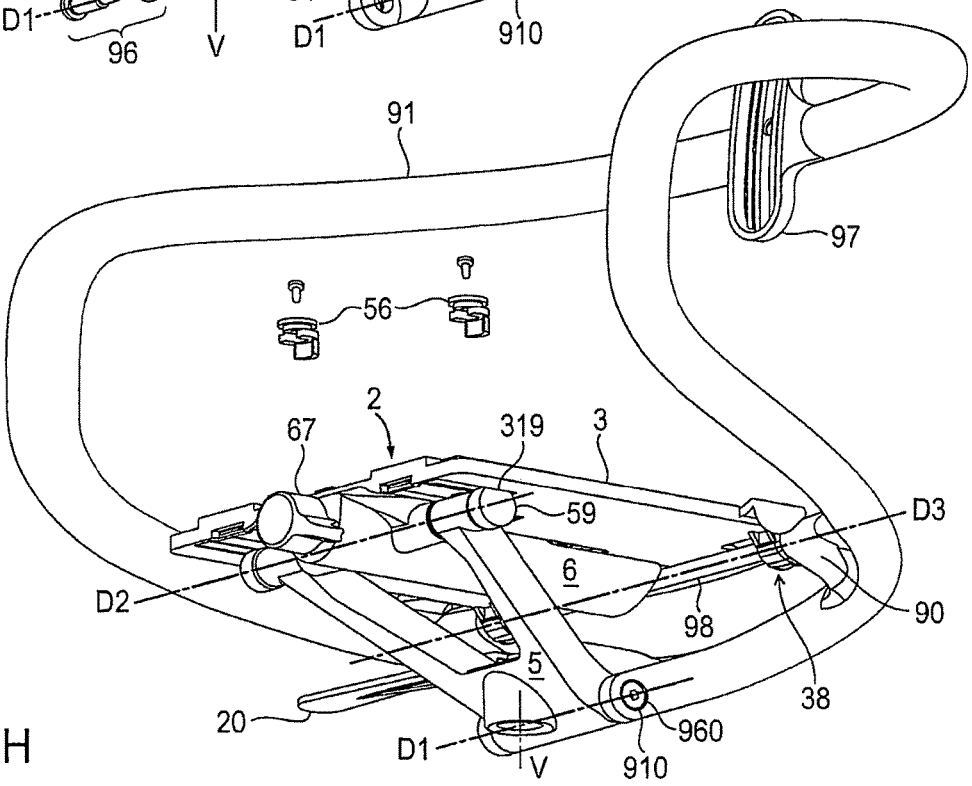
Fig. 10H

Fig. 13
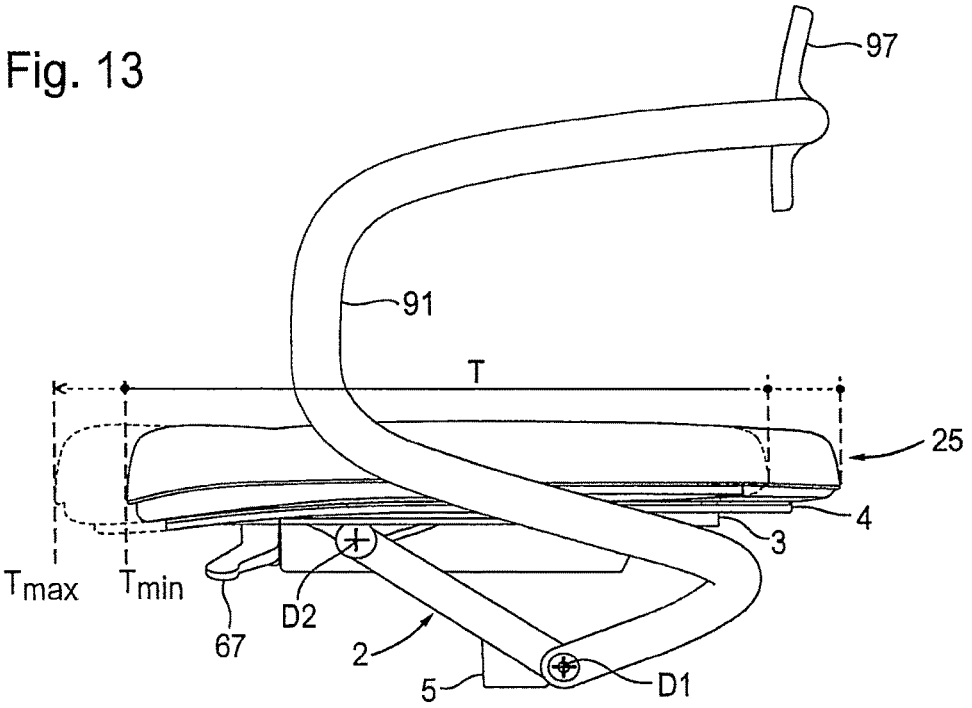
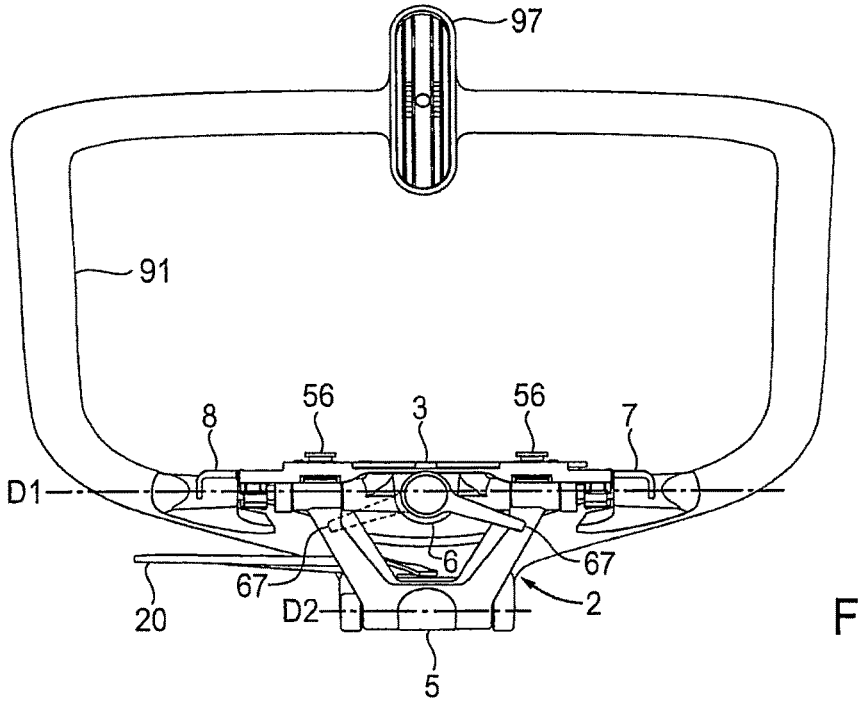
Fig. 14

CHAIR HAVING A DEFLECTION THAT IS MUTUALLY SYNCHRONOUS BETWEEN BACKREST AND A SEAT

FIELD OF THE INVENTION

The present invention relates to a chair which functions by means of a deflection that is mutually synchronous between a backrest and a seat over a range between a respective zero position of back inclination and of seat inclination and a respective maximum back inclination and maximum seat inclination. The mechanism that causes synchronous deflection has a spring unit arranged therein. The base support of a carrier unit is rigidly fastened to the underframe which is intended to be set on the floor. A stationary first axis of rotation and a stationary second axis of rotation extend through the base support. A back carrier is articulated on the first axis of rotation. A third axis of rotation, which moves around the first axis of rotation when the mechanism is adjusted, extends through the back carrier. A base plate lies movably on the base support at the front of the base plate and is articulated on the third axis of rotation at the rear of the base plate.

PRIOR ART

EP 1 039 815 B1 discloses a chair with an adjusting mechanism which causes the synchronous deflection between a backrest and a seat inclination. In this connection, the chair seat is placed on an underframe that is known per se with a vertically inserted gas spring for vertical adjustment. The seat support, which is arranged right at the bottom of the seat, is placed onto the telescopically extendable piston rod of the gas spring. The seat support supports a seat panel, and a pivotable back support is articulated on a main axis of rotation which extends transversely above the seat panel, parallel to the front edge thereof. An inclination spring is articulated at one end on the seat support on a stationary axis of rotation and at the other end to the back support on a moving axis of rotation. On its underside the seat panel has guide cranks in which supporting arms of the seat support engage so that they can be displaced transversely with respect to the main axis of rotation. The seat panel is articulated on the moving rotational axis, together with the inclination spring, on the back support. Two guide cranks spaced apart from one another are advantageously provided in the vicinity of the front edge of the seat panel, wherein the guide cranks have an end limit at the front as a stop. Bearing pins which are arranged right at the front of the free ends of the support arms engage in the guide cranks.

EP 2 086 373 B1 relates to a synchronizing mechanism for a chair with a seat resting on a seat support. An intermediate member, on which a two-armed seat base is articulated, is fastened on the chair column. The seat support is pivotable with regard to the seat base about a transverse axis. A seat back support is articulated on the intermediate member and at the rear on the seat support on a respective transverse axis. A spring which supports the movement of the seat support and the backrest support is arranged in the synchronizing mechanism. A sliding member extending in the longitudinal direction of the seat is articulated at the front on the seat base. When the seat support and the backrest support are moved, the sliding surface of the seat support is displaced in the longitudinal direction of the seat on a support surface of the sliding member. The rear end of the spring is provided on a fixed counter-bearing and the front end is provided on an axially adjustable counter-bearing which is entrained and thereby compresses the spring when the chair is deflected into the inclined position.

Object of the Invention

Starting from the condition of a mutually synchronous adjustment between a back inclination and a seat inclination on a chair, it is the object of the invention to provide a chair with a minimized mechanism, so that ergonomically optimal performance characteristics are obtained, cost-effective mass production with regard to the material and assembly costs is made possible, and the construction enables an aesthetic design of the chair.

Overview of the Invention

The chair which functions by means of a deflection that is mutually synchronous between a backrest and a seat over a range between a respective zero position of back inclination and of seat inclination and a respective maximum back inclination and maximum seat inclination comprises:

- an underframe intended to be set on the floor;
- a mechanism that causes the synchronous deflection with a spring unit arranged therein;
- a carrier unit with a base support which is rigidly fastened on the underframe and through which a stationary first axis of rotation and a stationary second axis of rotation extend;
- a back support which is articulated on the first axis of rotation and through which a third axis of rotation extends, which moves around the first axis of rotation when the mechanism is adjusted;
- a base plate that is movably located above the base support at the front and is articulated on the third axis of rotation at the rear.

The U-shaped base support is designed with a center part and two arms extending upwards therefrom, which arms each have a shaped piece protruding upwards, which shaped pieces each engage in an associated opening in the base plate. When the mechanism is deflected, a relative displacement between the stationary shaped pieces and the openings arises. The two openings are oriented in the direction of the seat depth and thus at right angles to the transversely extending axes of rotation.

Special embodiments of the invention are defined below: By means of an actuator unit, the relative displacement of the shaped pieces in the openings can be blocked for locking of the zero position of the back inclination and the seat inclination.

The shaped pieces each have a crown element which is undercut like a mushroom and projects over the width of the openings, and thus forms a hold-down device for the base plate and secures the guiding of the shaped pieces in the respective associated opening.

The seat is a component placed onto the base plate and secured thereon by positive engagement, with a lower base plate that preferably supports a cushion provided with a cover. Keyhole-shaped elongate holes, which extend in the direction of the seat depth and in each case have a widened portion, are provided in the base plate. Lugs having a mushroom-shaped undercut project from the top side of the base plate, which lugs together with the crown elements are intended for passage through the widened portions of the elongate holes when the seat is placed onto the base plate, and after displacement of the seat in the direction of maximum seat depth—in the finished fitted position—the lugs engage behind the elongate holes. In the finally fitted position of the seat a stopper for the base plate strikes the base plate and thus secures the seat against inadvertent release of the base plate.

The spring unit has a housing in which a helical spring under tensile stress is located and the first end of the helical spring is fixed. The housing is articulated on the second axis of rotation. The second end of the helical spring is anchored to the base plate.

The housing of the spring unit is inserted into an opening in the base plate. The housing has a spring adjuster, to which the first end of the helical spring is attached, in order to select the intensity of the pretensioning of the helical spring when the spring adjuster is actuated. The second end of the helical spring is fastened to an end piece that is retained in a pocket of the base plate.

The actuator unit arranged on the top side of the base plate comprises a slider connected to the switching lever that blocks or unblocks the relative displacement of the shaped pieces in the openings depending upon the position.

A connector that transmits the movement on the switching lever to the slider is arranged between the switching lever and the slider. The one-piece slider comprises:

- an arm part that, on one side, merges into an angled branch that ends with a buffer edge;
- a plate part on the other side of the arm part, which plate part has an inner planar cutout from which the cutout extends into a side part; and
- guide contours along the arm part.

The buffer edge on the branch is at the same height as a buffer edge delimiting the side part on one side. When the switching lever is positioned for the locking of the synchronous deflection of the backrest and the seat out of the zero position of the back inclination and the seat inclination, the two buffer edges on the slider are intended to be positioned at the shaped pieces and thus to block the relative displacement thereof in the openings.

The switching lever has a latching element fitted on a securing spring, and an anchor contour is arranged on the top side of the base plate. In the two end positions of the switching lever for locking or unlocking the synchronous deflection of the backrest and the seat the latching element comes into engagement with the anchor contour and thus stabilizes the binary switching function. A transmission spring is arranged between the switching lever and the connector and forms a storage member during switching of the switching lever, specifically:

- when switching to locking of the synchronous deflection of the backrest and the seat during a deflection of the backrest out of the zero position of back inclination and seat inclination with corresponding inclination of the seat, wherein, as soon as the zero position of the back inclination and seat inclination is assumed, the energy stored by the switching in the transmission spring moves the slider into the locked position; and
- when switching to unlocking of the synchronous deflection of the backrest and the seat in a zero position of back inclination weight-loaded by the user, wherein as soon as the weight loading falls below a defined value in the zero position of the back inclination, the energy stored by the switching in the transmission spring moves the slider into the unlocked position.

The guide contours provided on the slider along the arm part thereof cooperate by positive engagement with guide pieces provided on the top side of the base plate, in order to guide the slider securely along its movement path.

On the second axis of rotation a roller, on which the base plate rolls during the synchronous deflection of the backrest and the seat, is arranged in each case on the outside of the two arms of the base support for the purpose of reducing the friction. The rollers are embedded in roller tracks recessed in the form of a groove on the underside of the base plate, so that a guide is produced between the rollers and the base plate. On the base plate recesses are positioned in the region of the openings and serve to receive cover strips which close the openings from the underside of the base plate as a protection against jamming.

The back carrier is a symmetrically shaped frame with multiple bends, preferably constructed as an integrally produced injection molded plastic part. An axial hole extends in each case through the two free ends of the back carrier, the axial holes being aligned with one another and intended for the articulation on the first axis of rotation. A horizontal rear hinge rod, on which the rear region of the base plate is articulated, extends on the third axis of rotation and is inserted upwards from the free ends into the back carrier.

The back carrier is provided centrally at the top with a connector that serves for fastening of a backrest part that can preferably be fixed in a selectable vertical position to the connector. An extension is directed downwards from each side of the base plate and has a downwardly open axial recess which is intended for overlapping attachment to the hinge rod. Shell-shaped inserts inserted into the axial recesses surround the respective portion of the hinge rod extending therethrough and have a bearing function, and at the same time these inserts prevent the inadvertent decoupling of the hinge rod from the extensions.

A pattern is provided on the underside of the base plate. A depth-adjusting lever is guided on the top side of the base plate and has a complementary counter-contour for interlinking with the pattern. By actuation of the depth-adjusting lever the interlinking between the pattern and the counter-contour can be temporarily released, in order to displace the seat mounted on the base plate to a selectable seat depth while the interlinking is in the released state.

A gas spring which is adjustable in height is arranged in a vertical tube in the underframe, and the base support supporting the mechanism that in turn supports the seat is fastened to the gas spring. The seat can be adjusted to a height that meets the user's requirements by means of actuation of a height-adjusting lever that activates the gas spring. The assembly consisting of the seat and the backrest is rotatable about a vertical axis on the underframe.

BRIEF DESCRIPTION OF THE APPENDED DRAWINGS

Figure 1D:
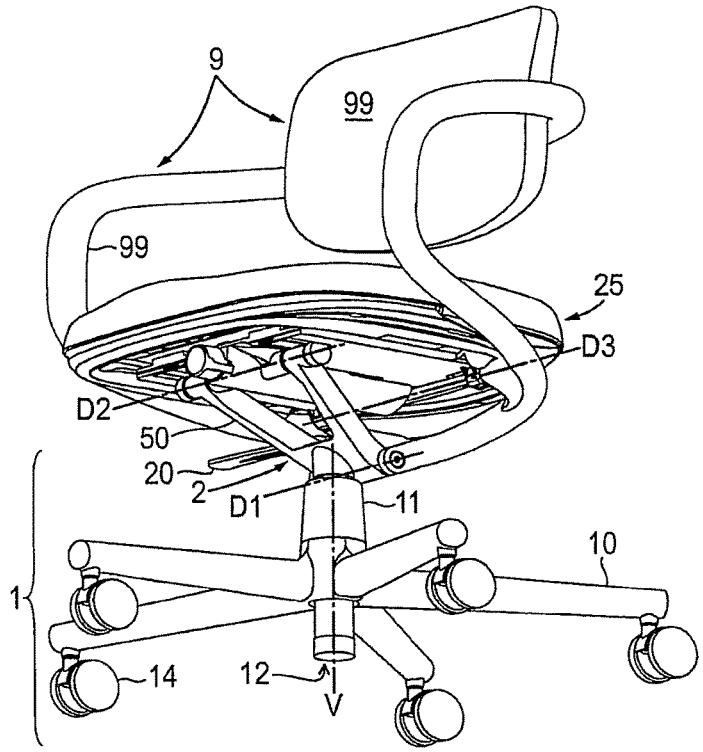
Figure 1E:
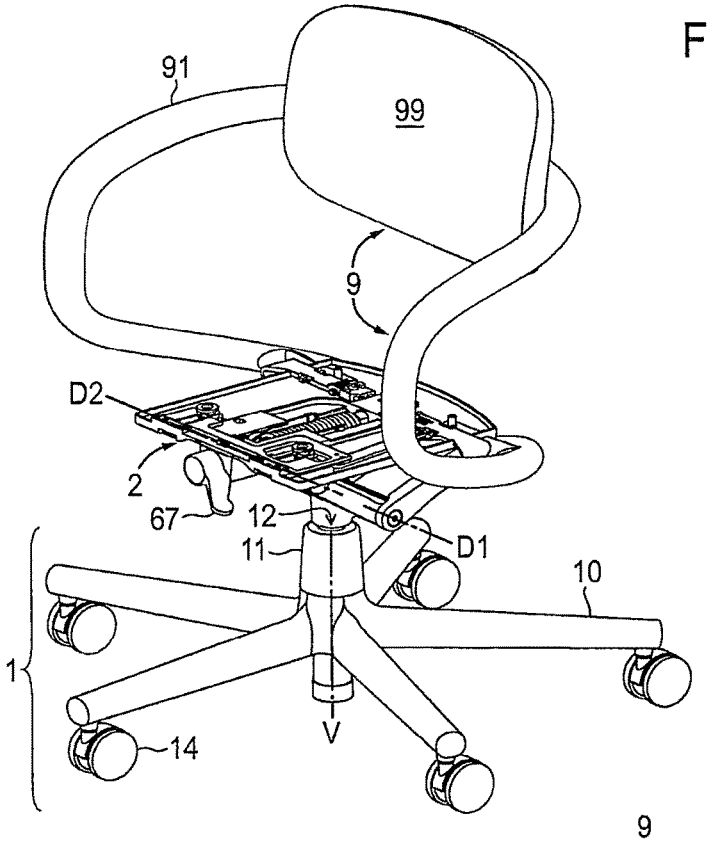
Figure 1F:
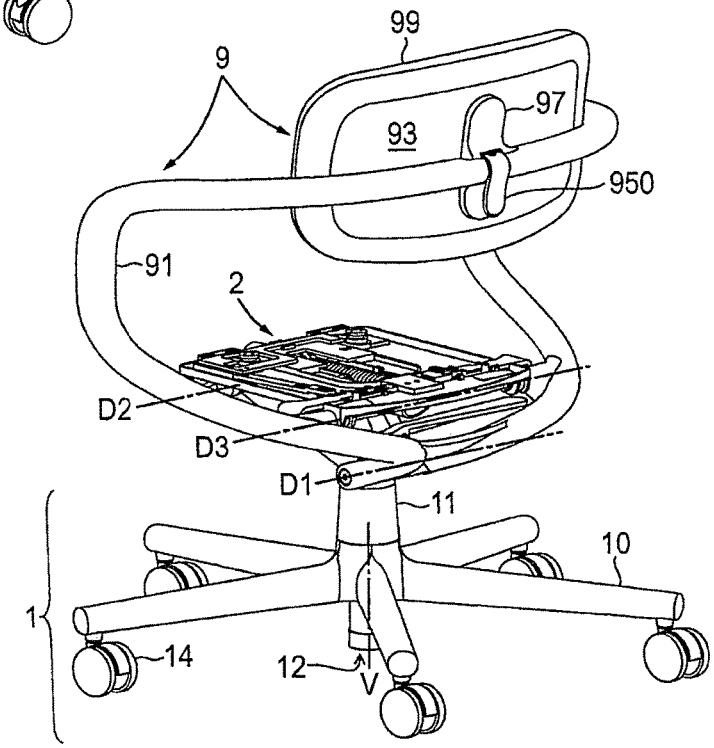
Figure 1G:
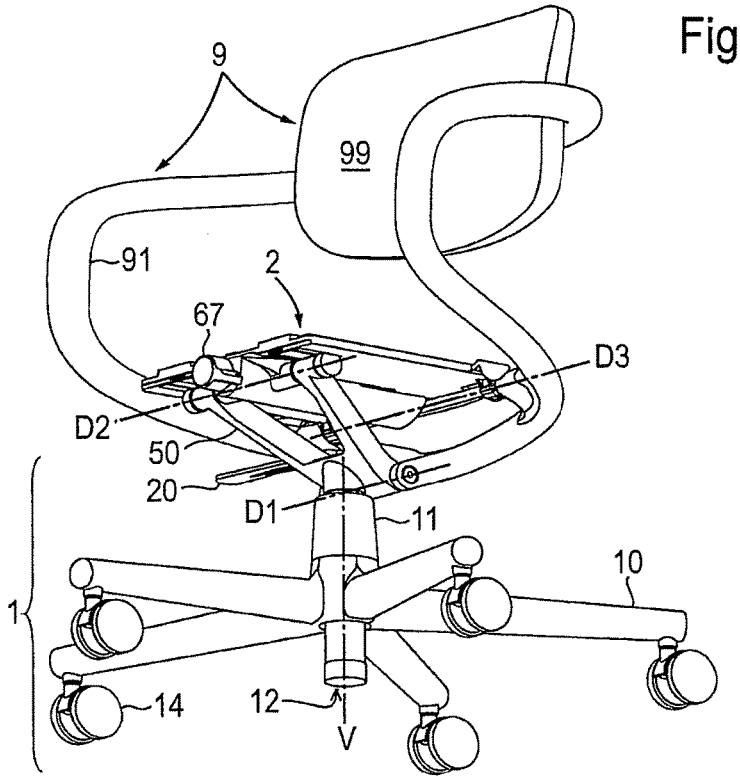
Figure 1H:
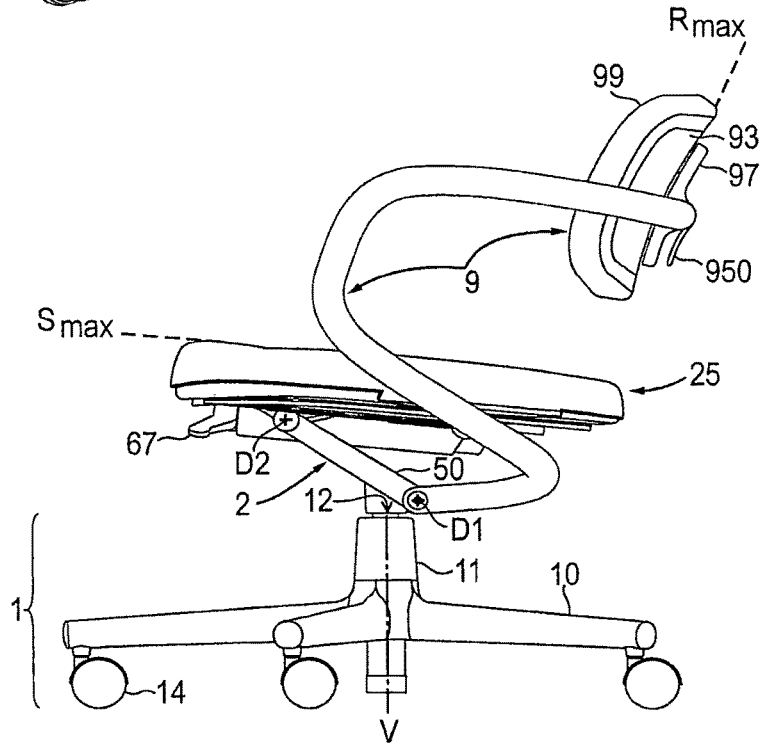
Figure 2A:
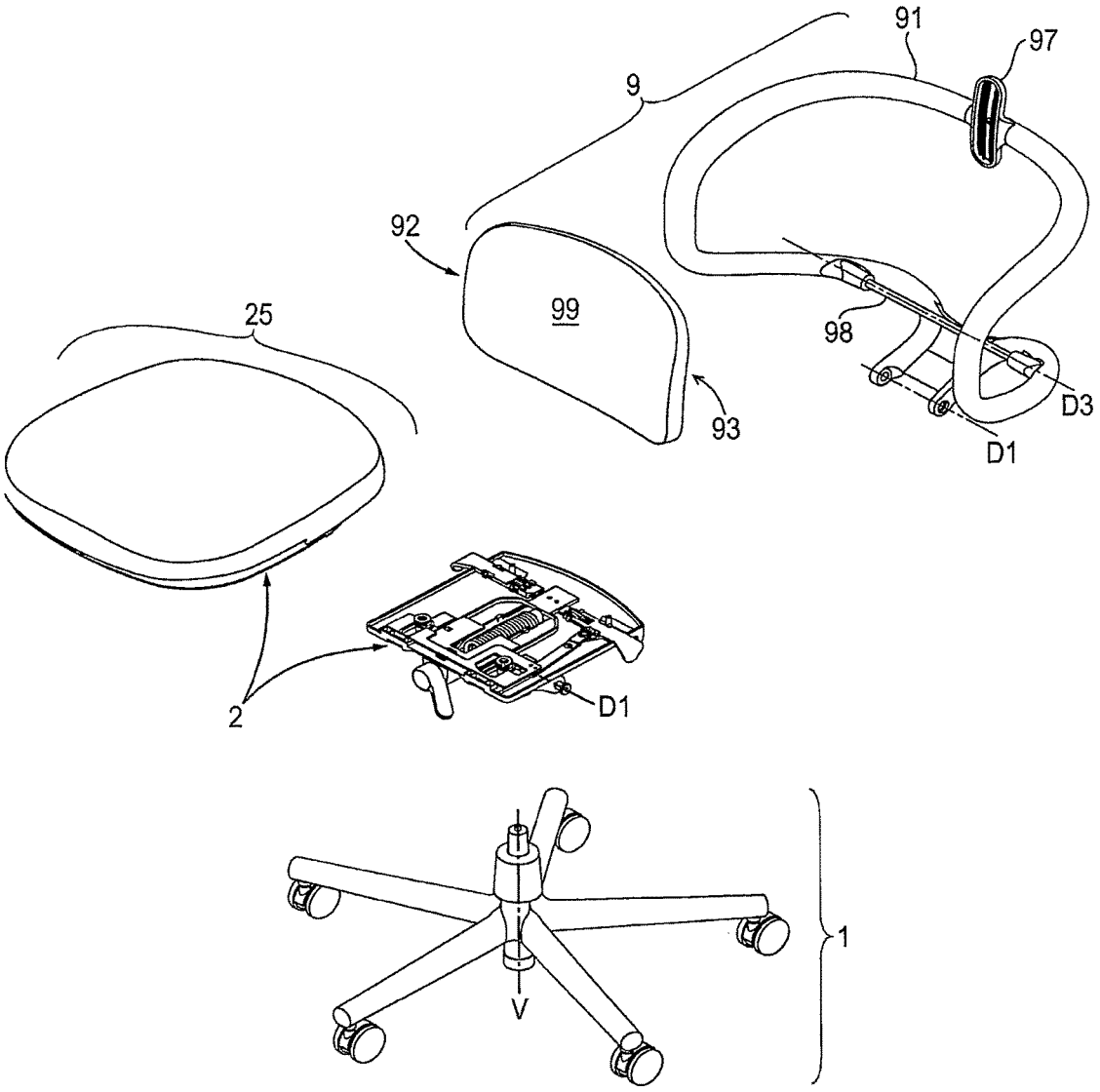
Figure 2B:
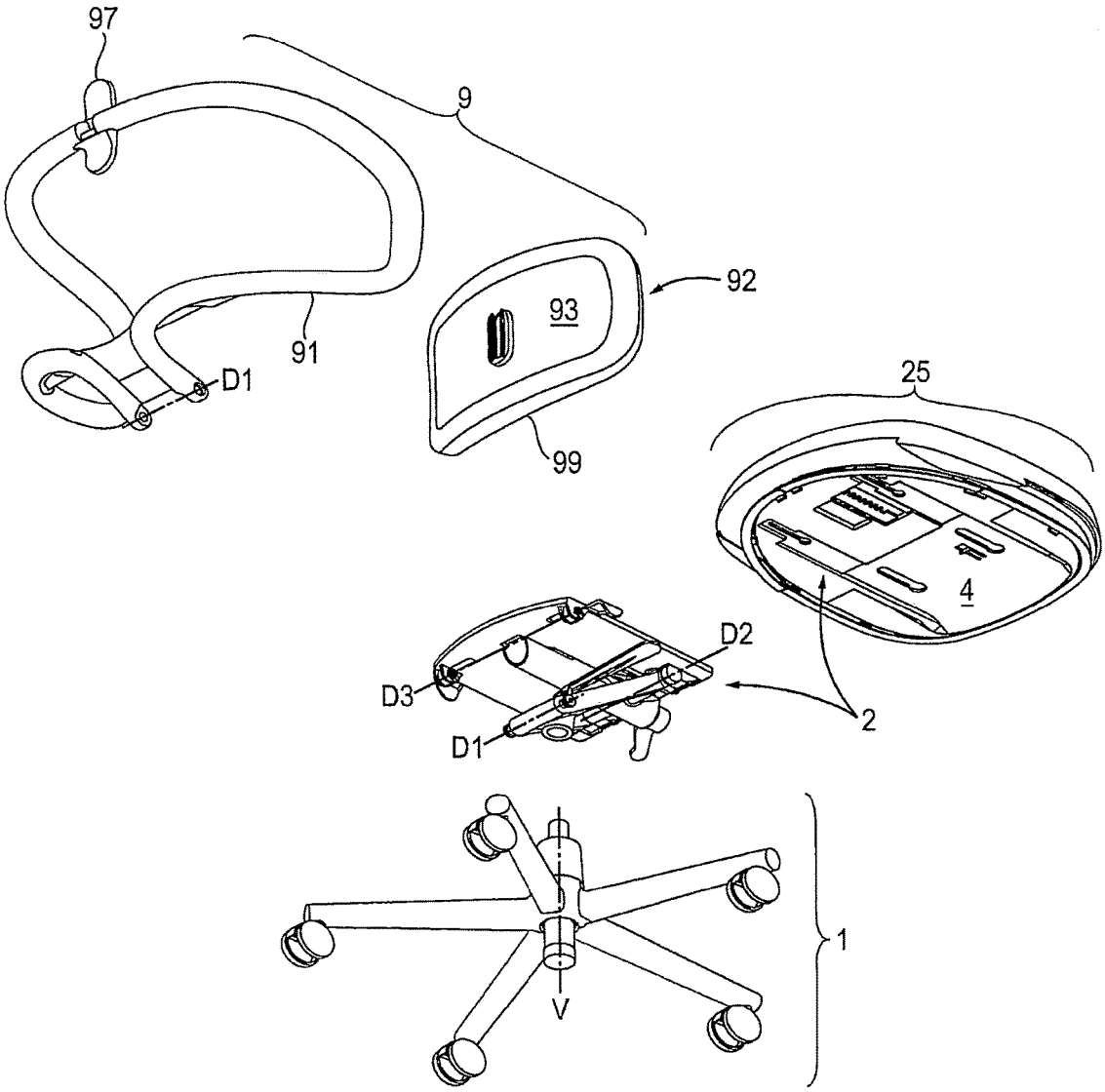
Figure 3A:
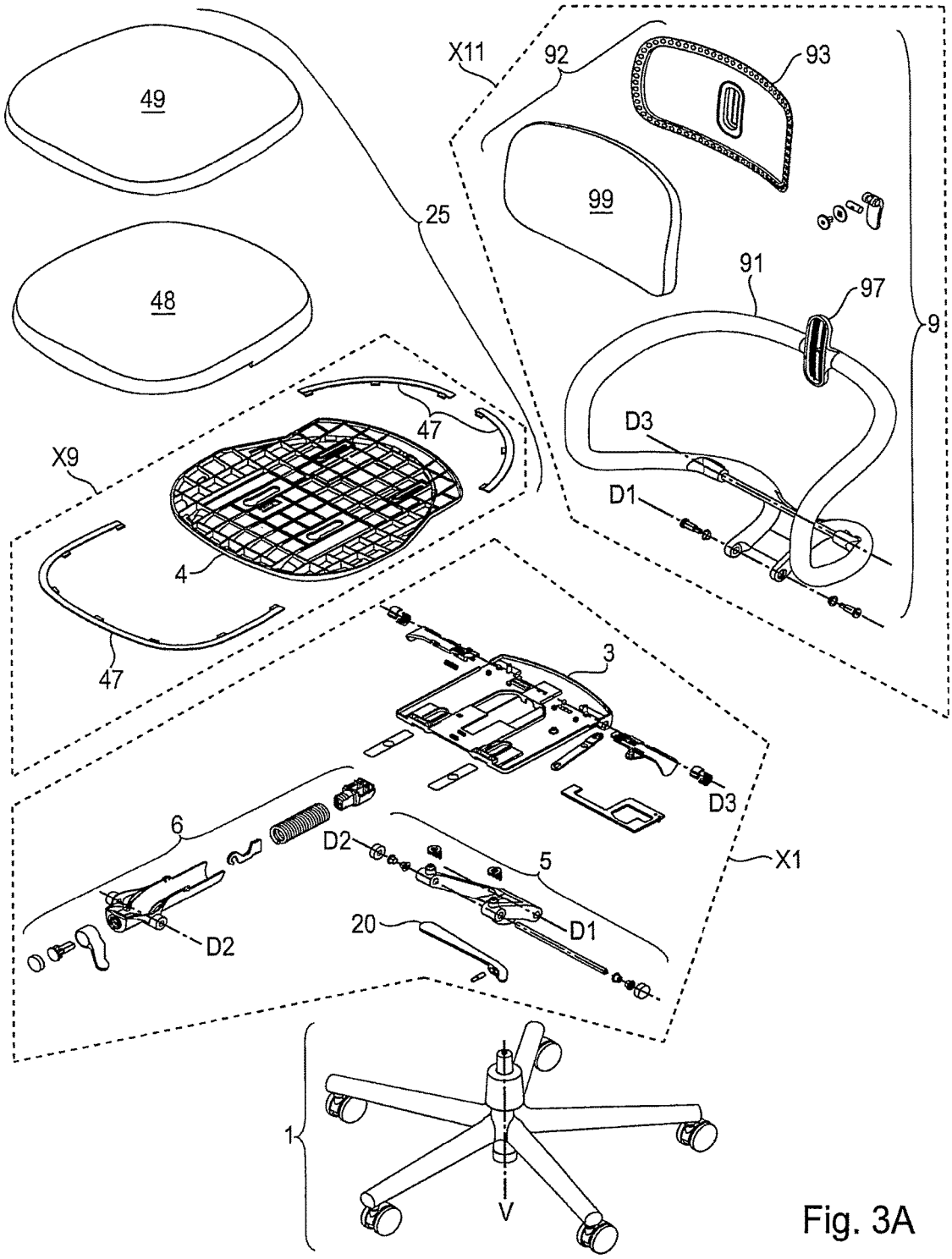
Figure 3B:
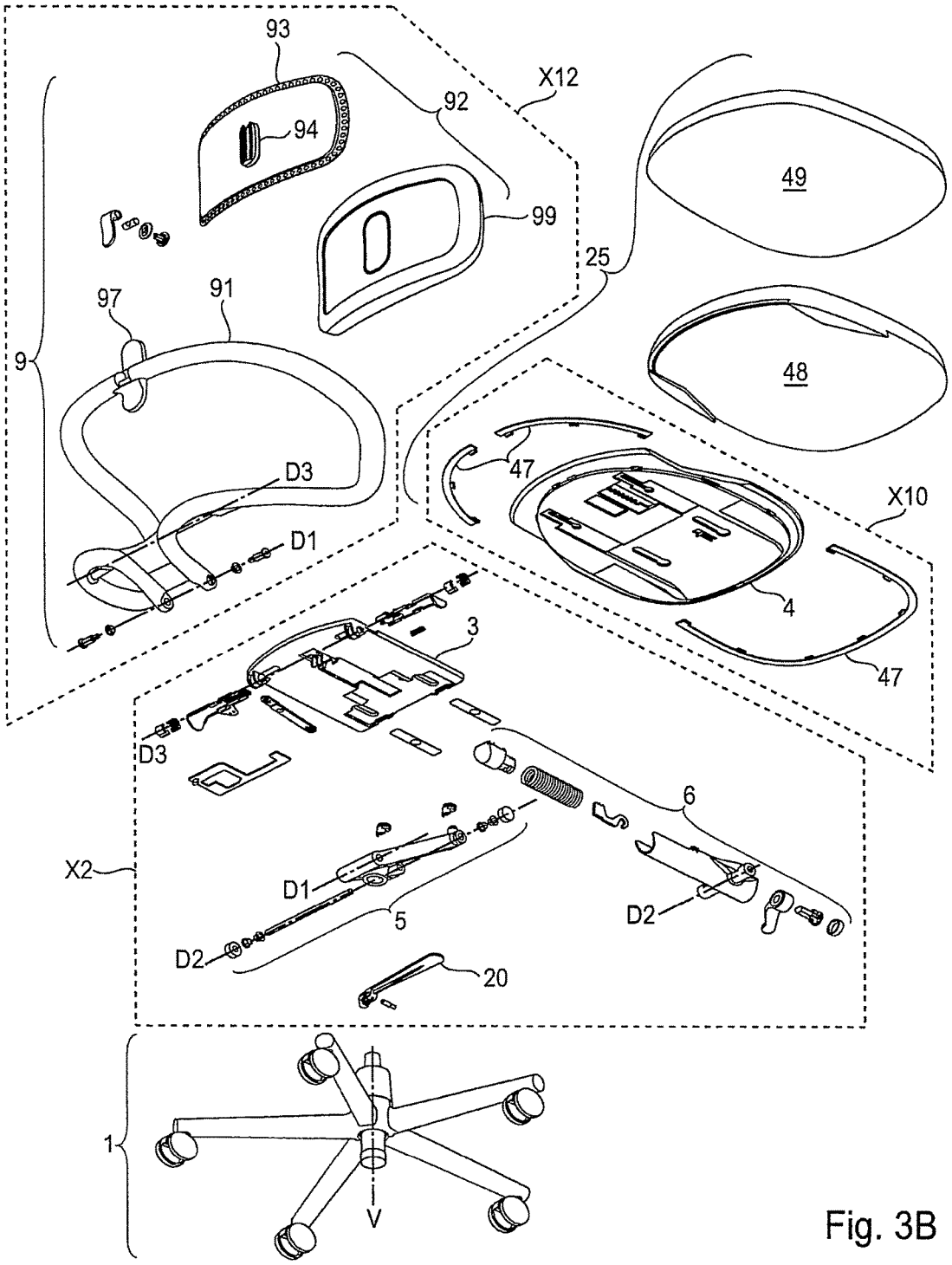
Figure 4A:
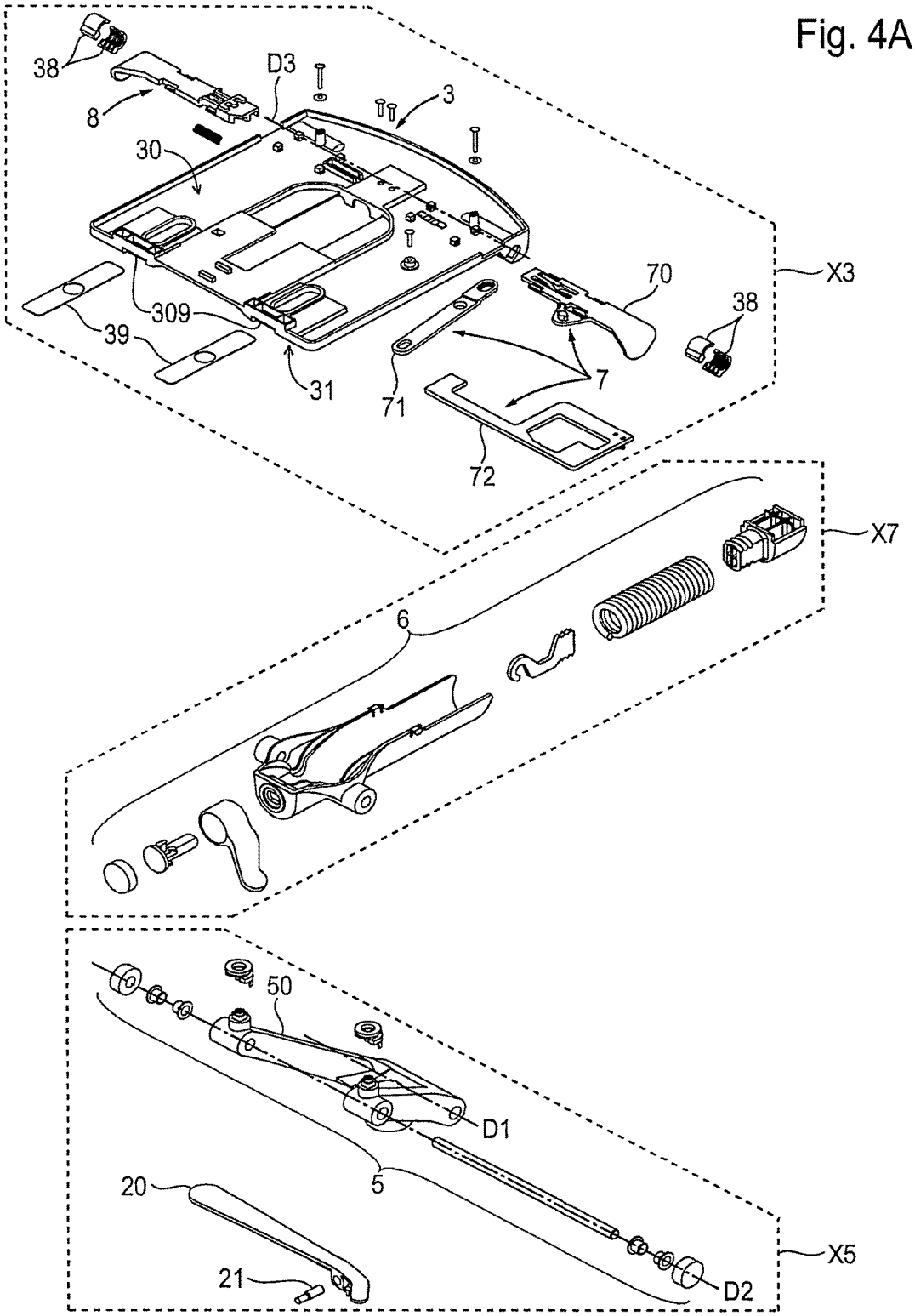
Figure 4B:
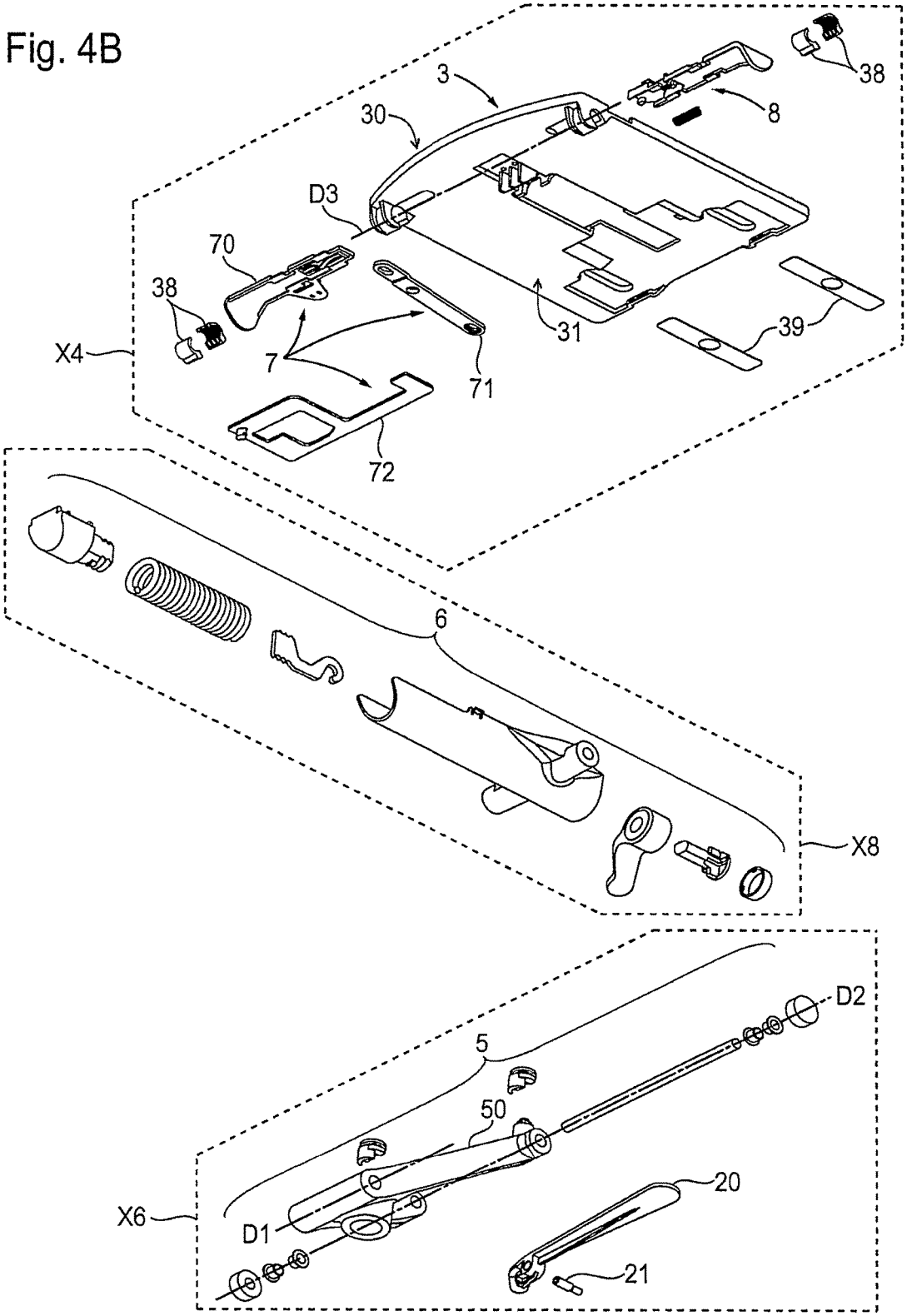
Figure 5A:
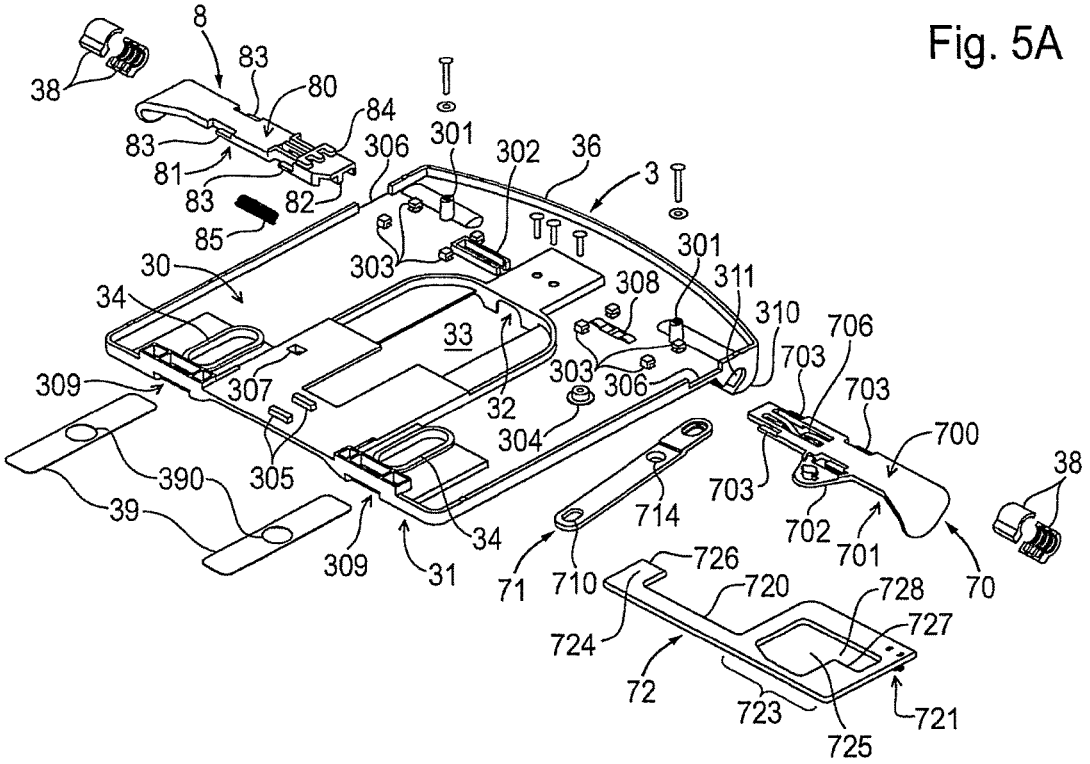
Figure 5B:
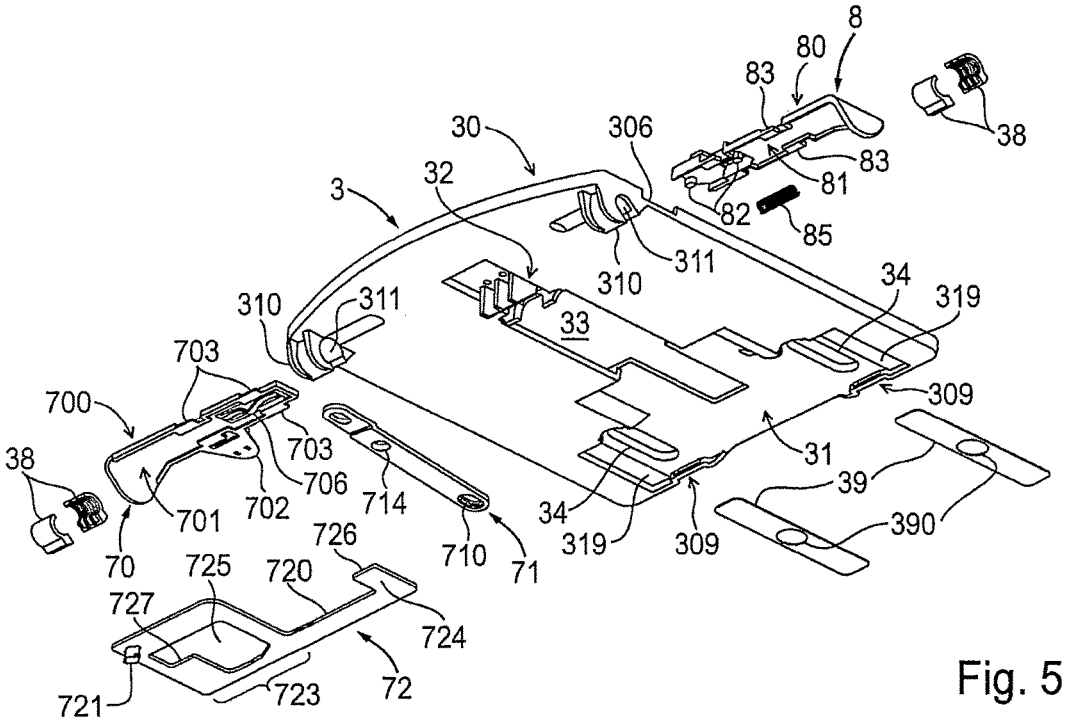
Figure 9A:
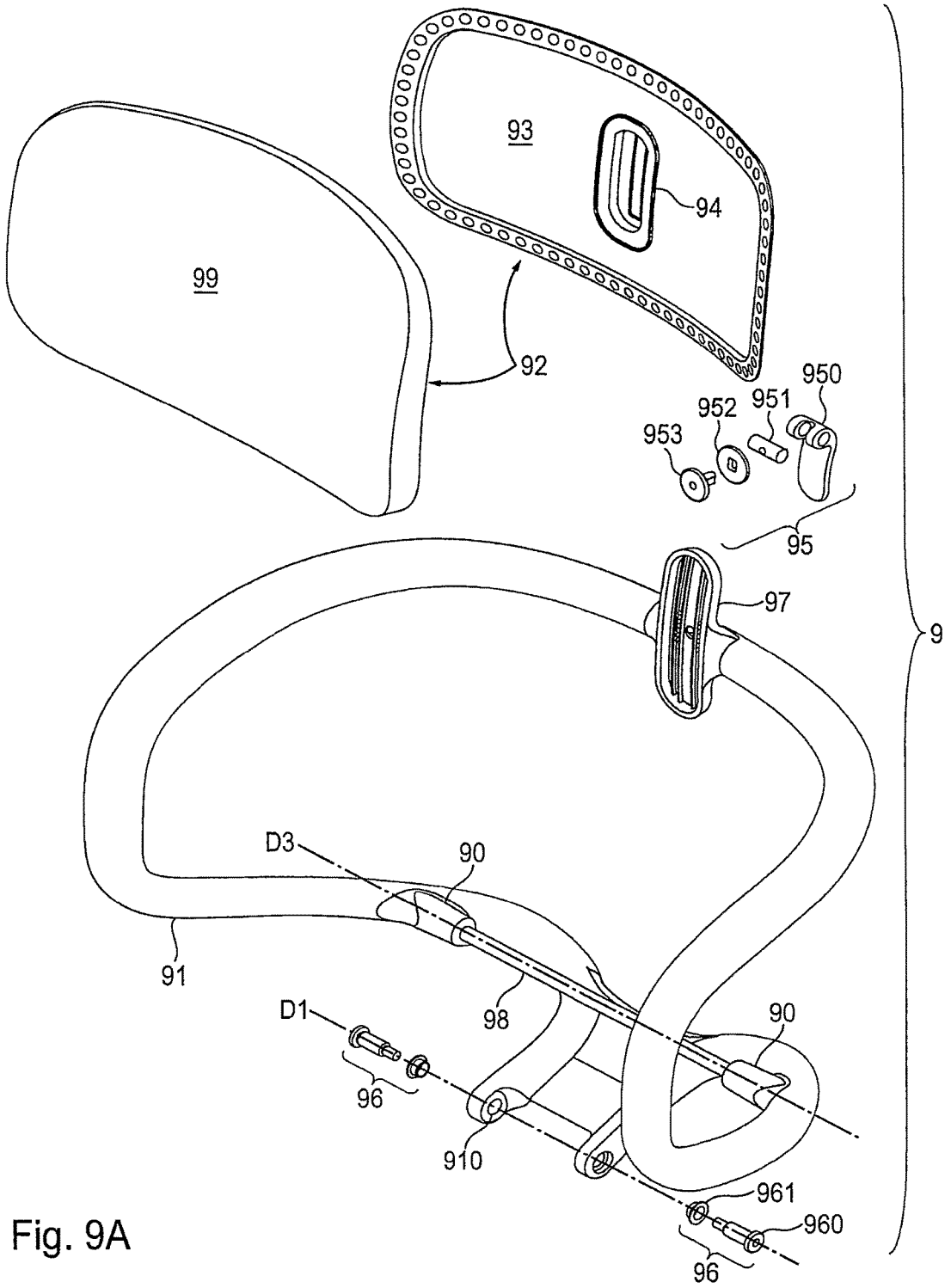
Figure 9B:
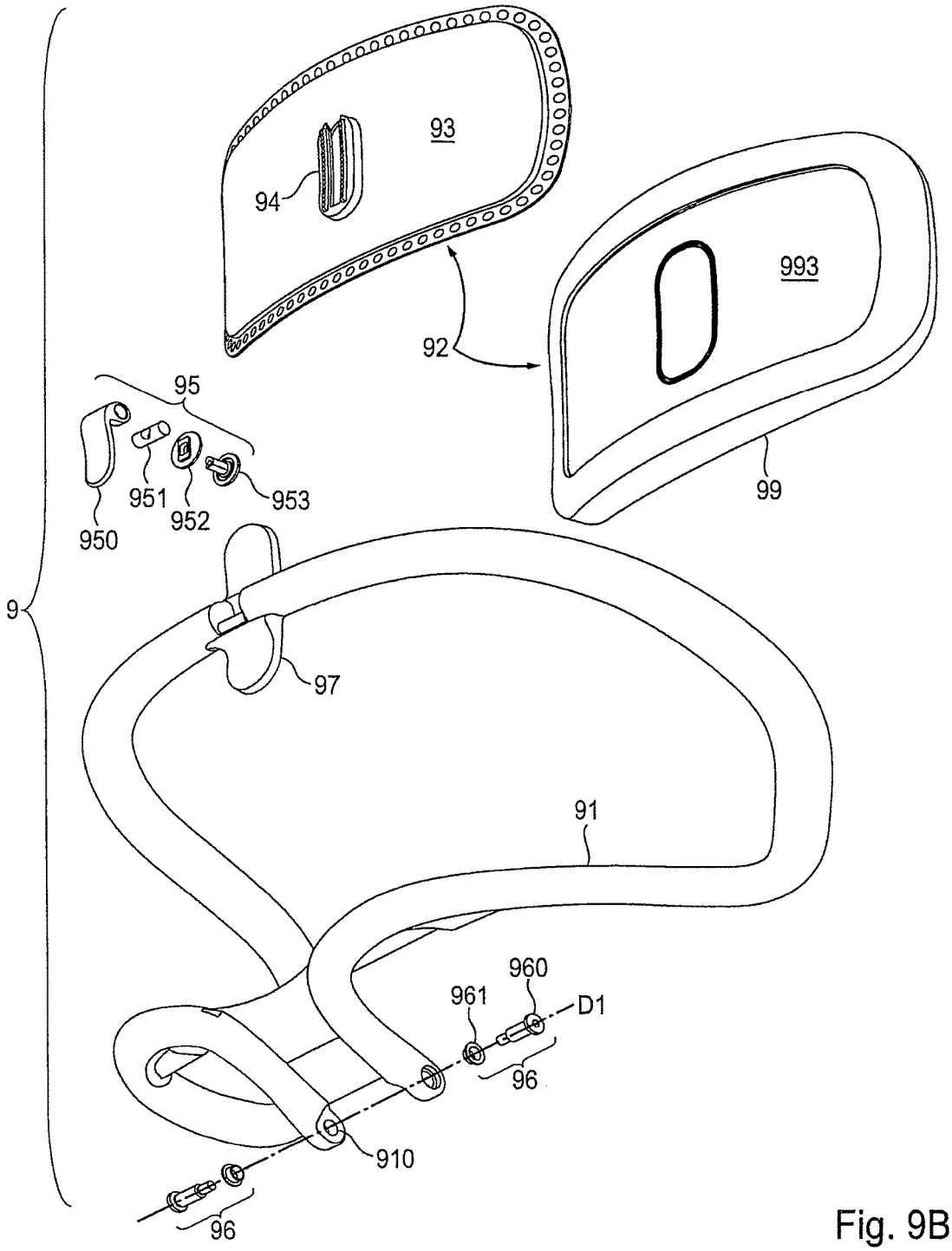
Figure 10A:
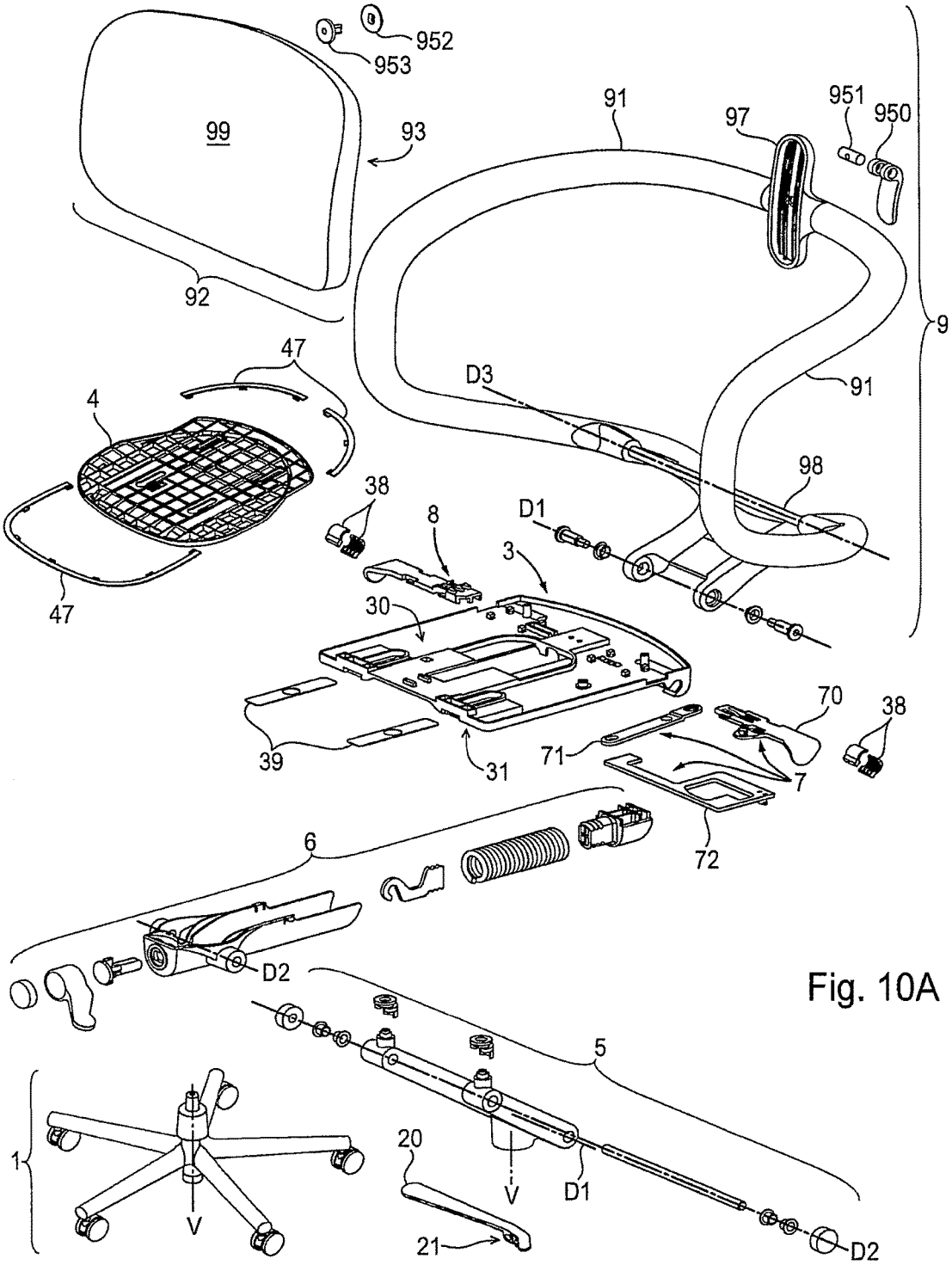
Figure 10B:
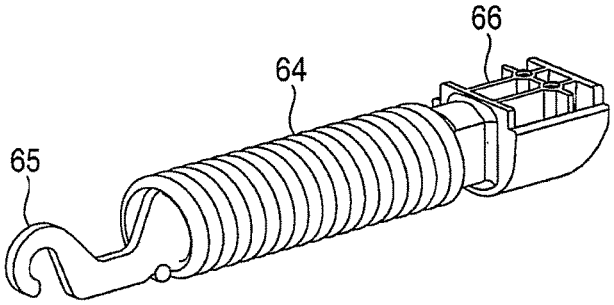
Figure 10C:
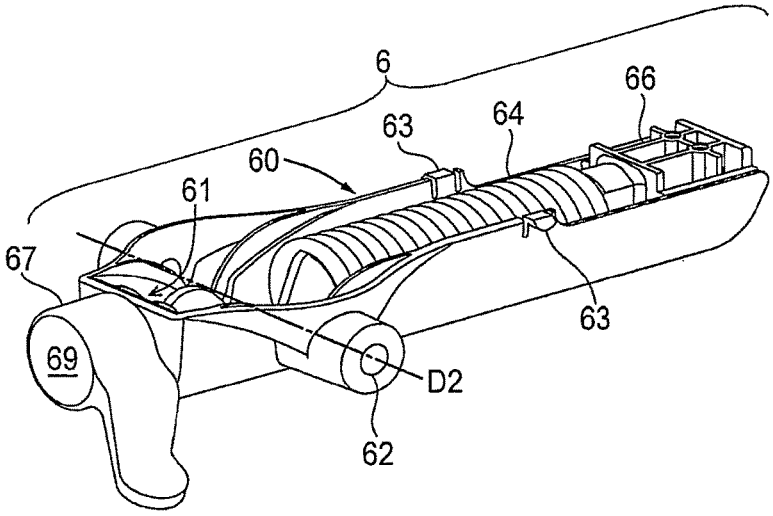
Figure 10D:
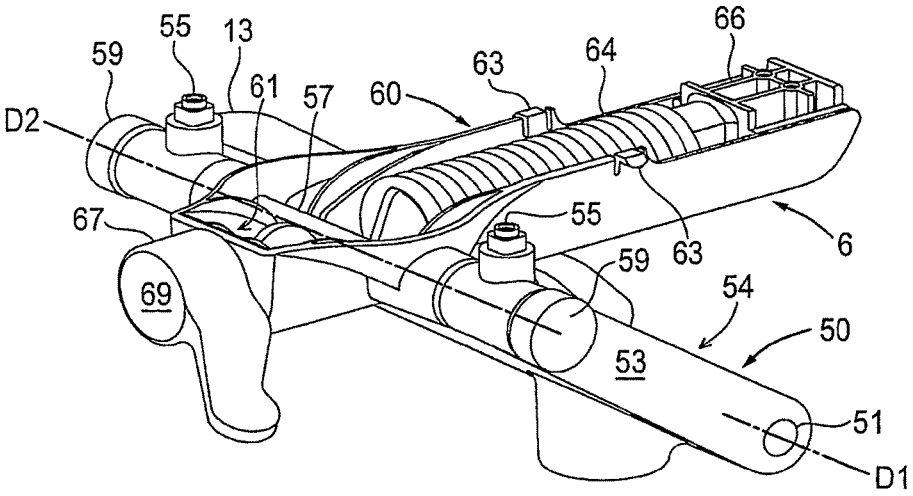
Figure 10J:
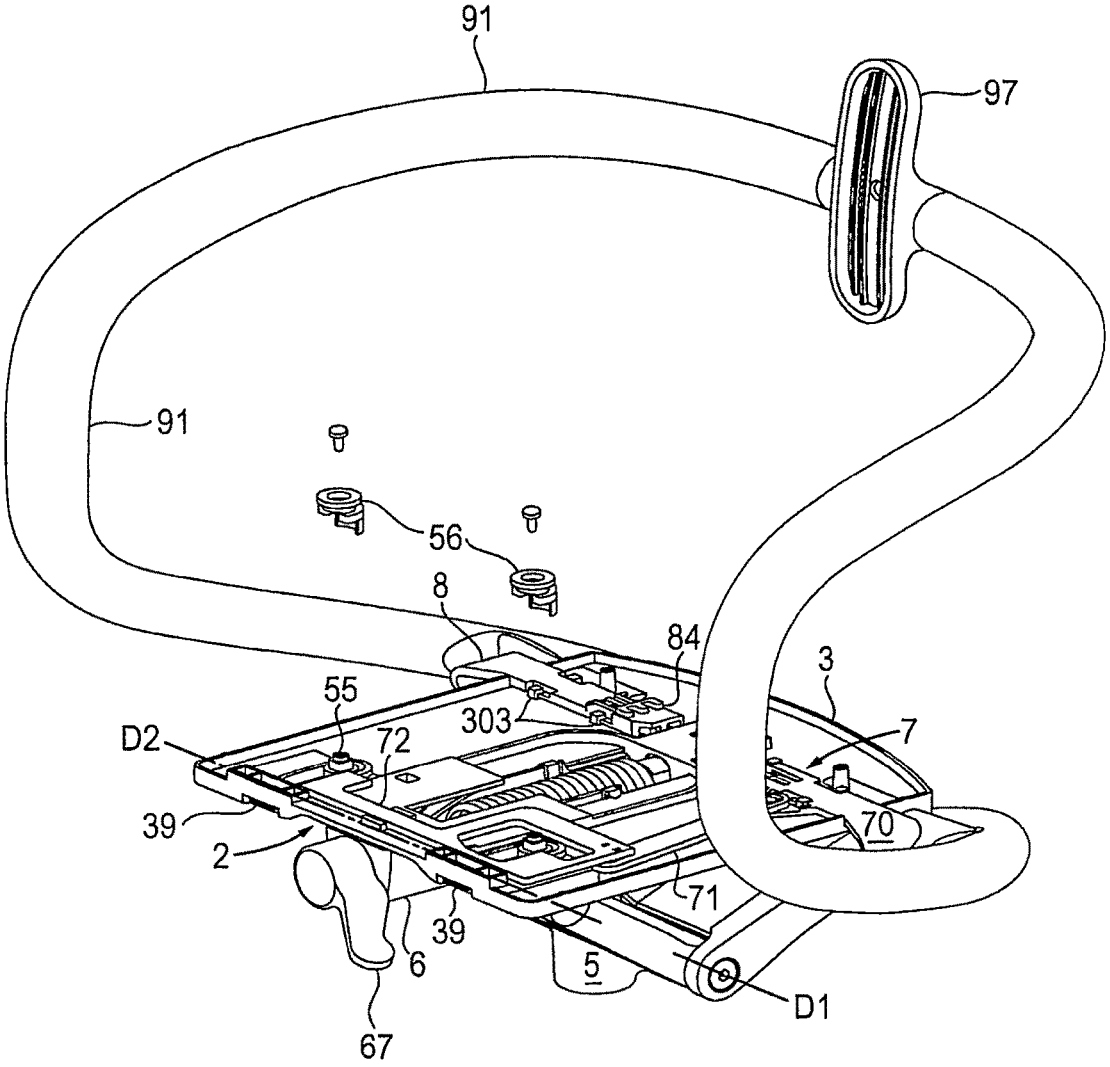
Figure 10K:
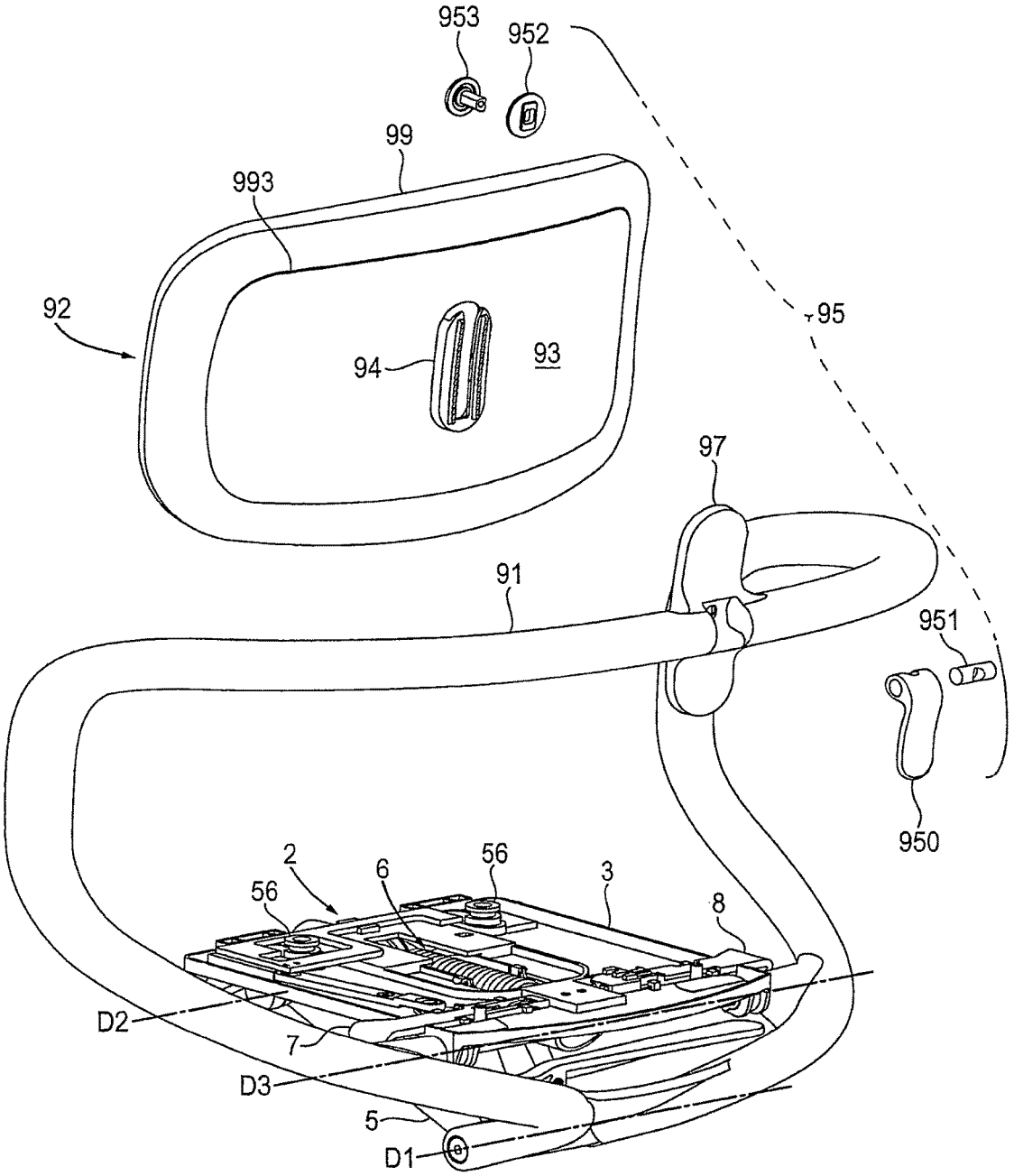
Figure 11A:
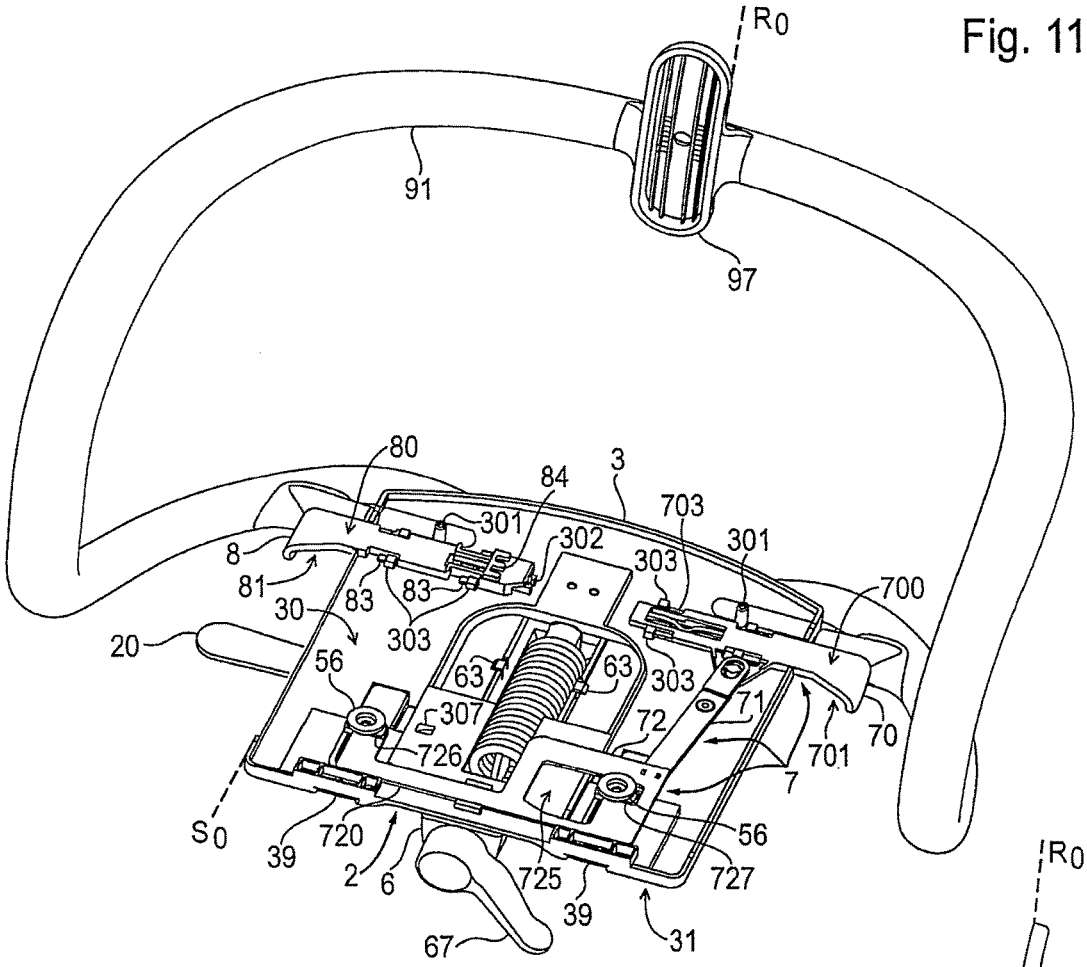
Figure 11B:
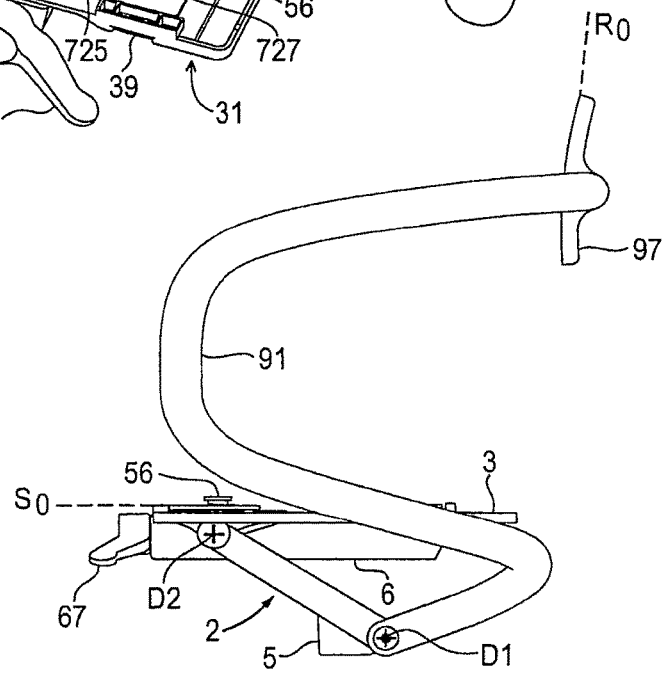
Figure 11C:
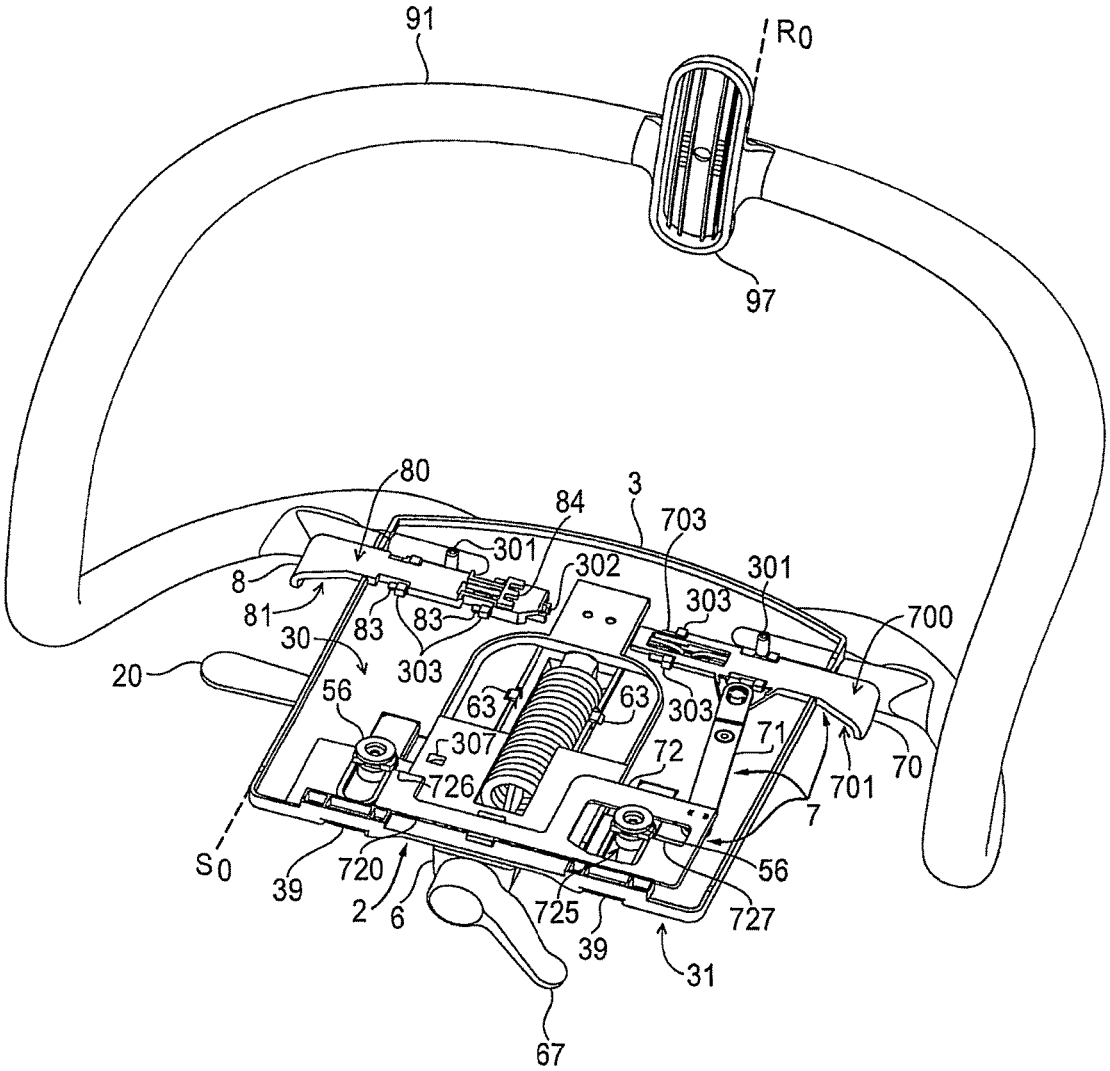
Figure 11D:
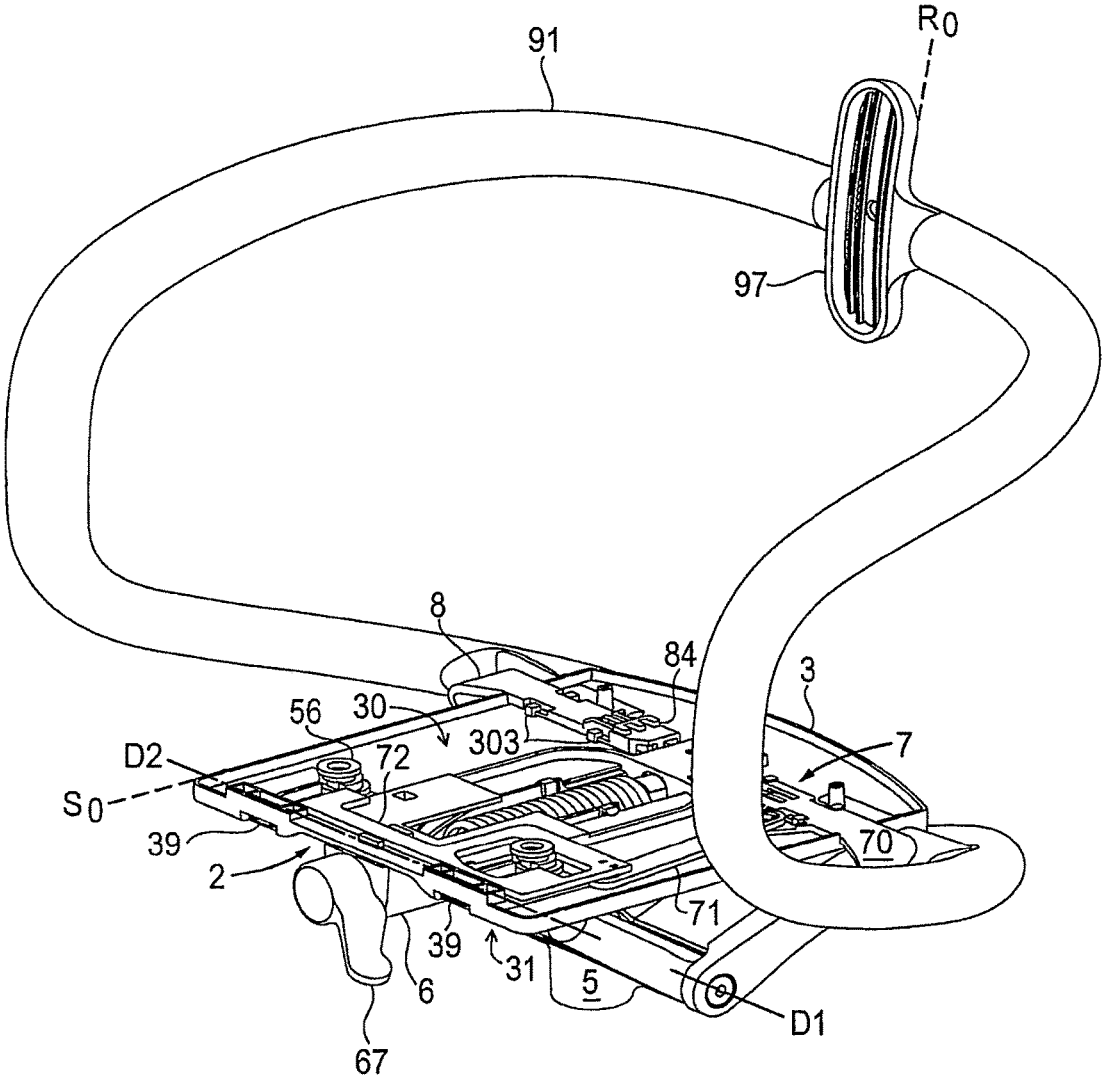
Figure 11E:
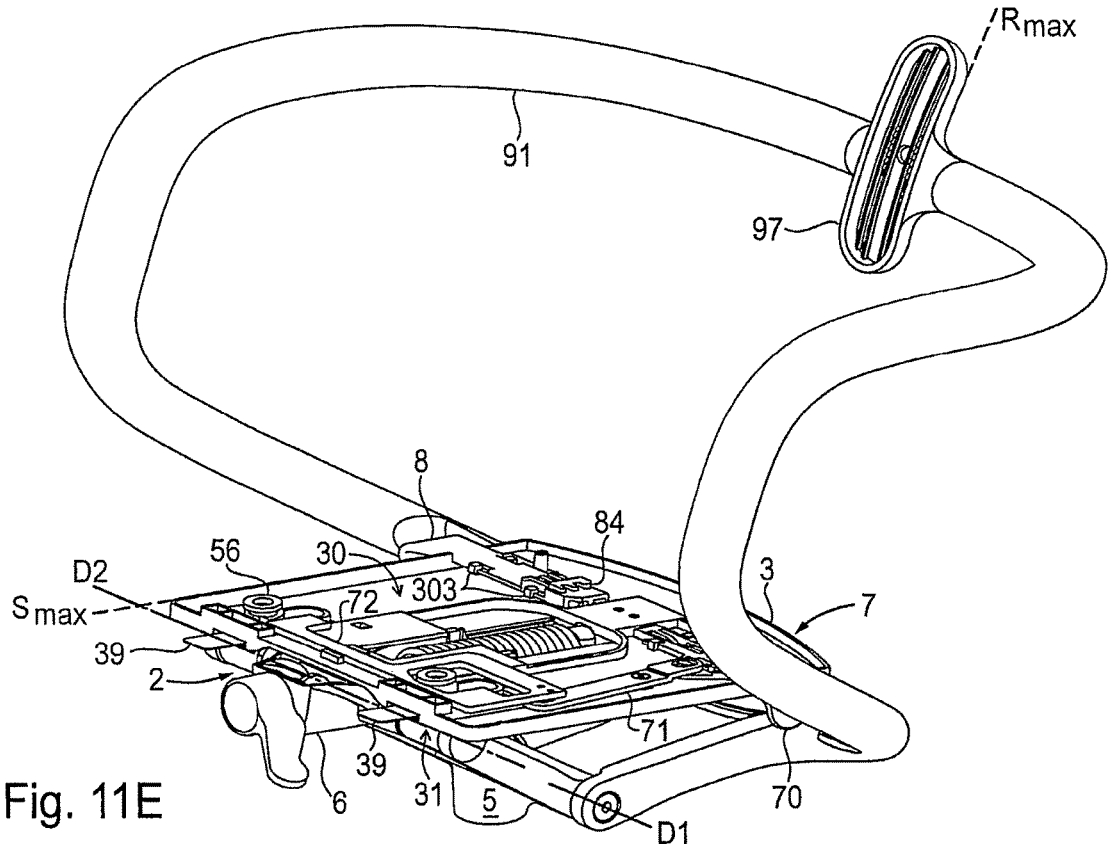
Figure 11F:
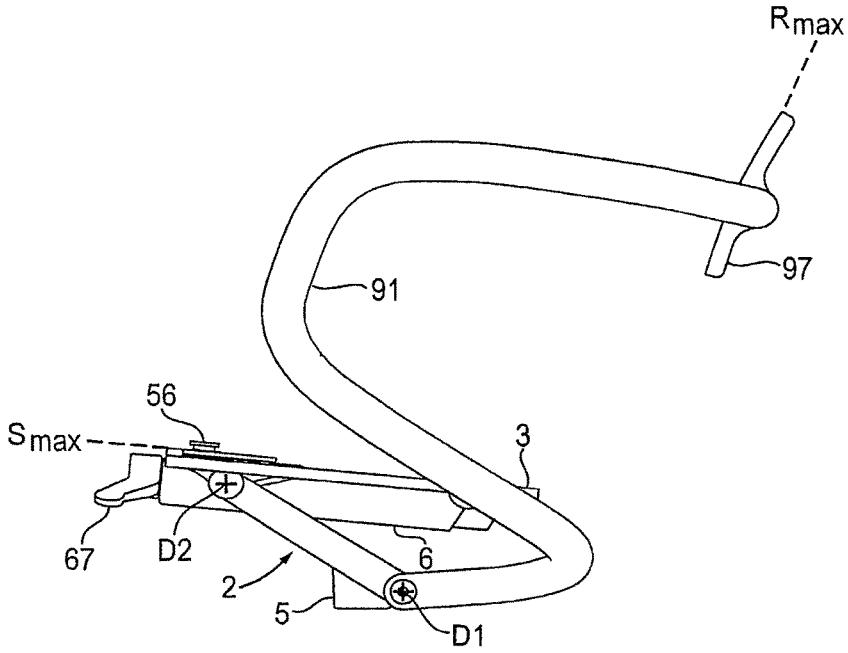
Figure 12A:
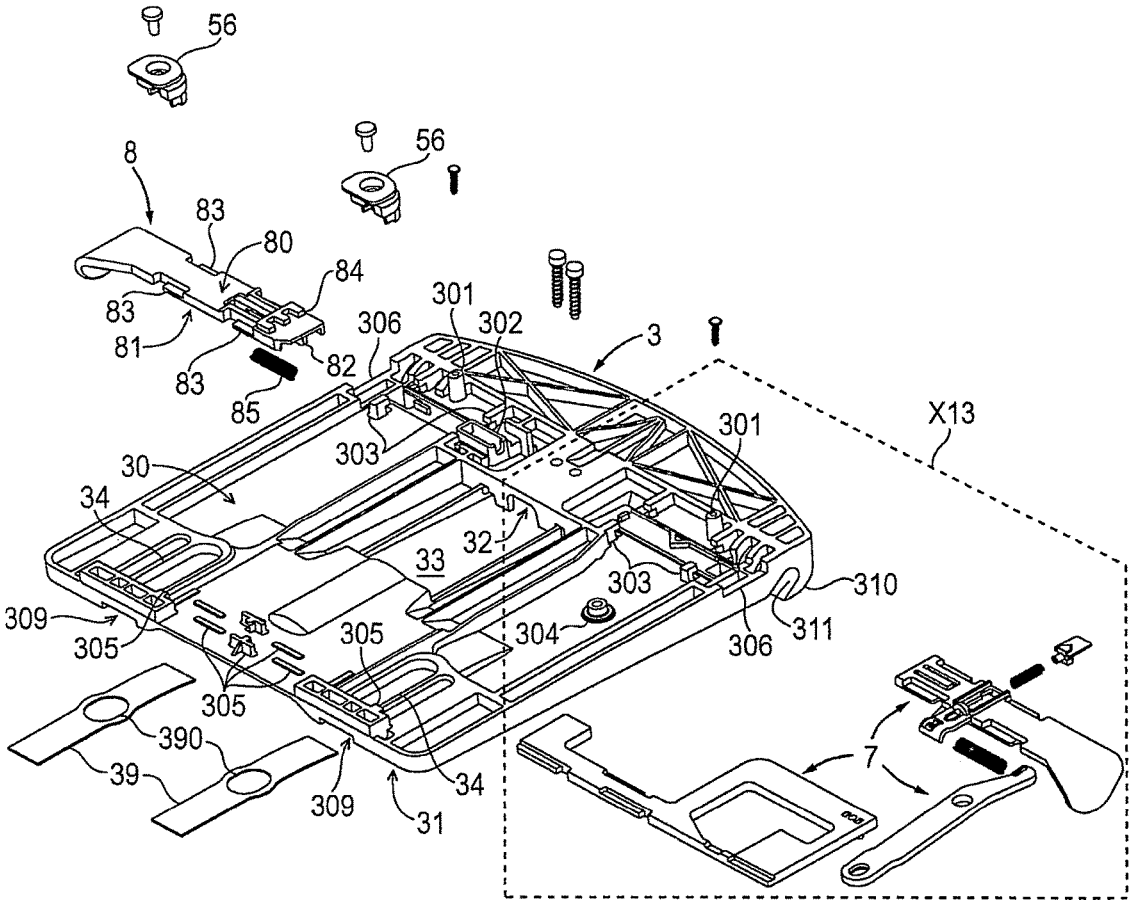
Figure 12B:
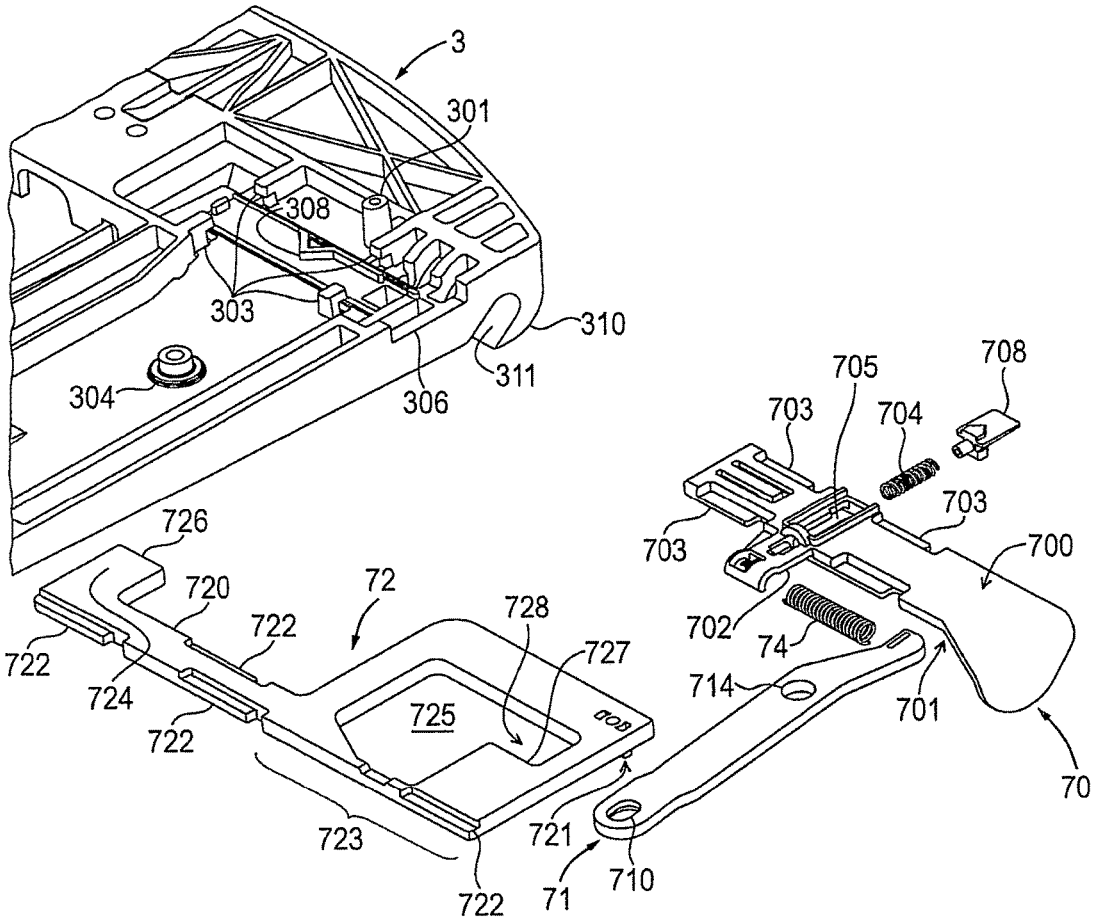
Figure 12C:
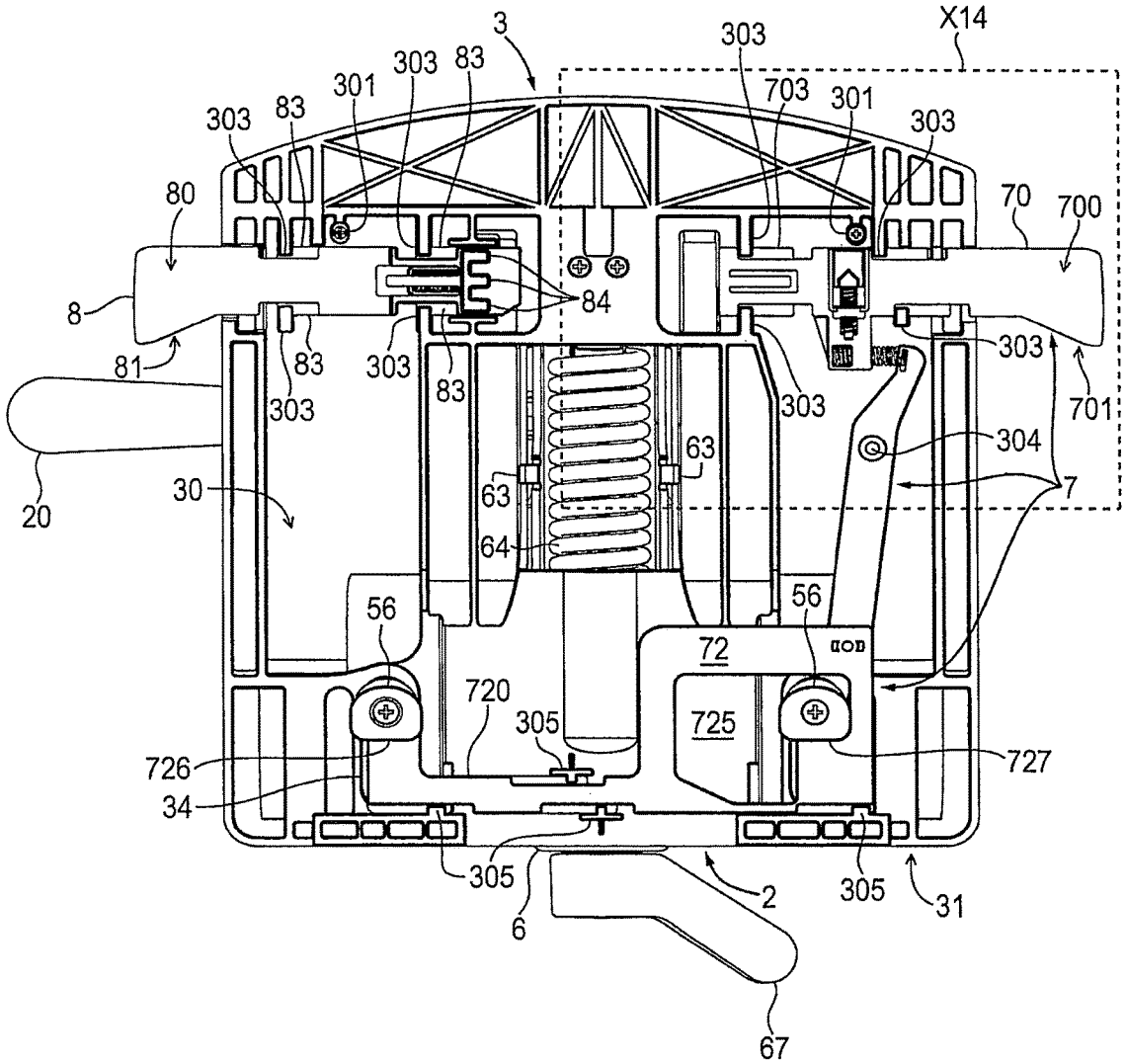
Figure 12D:
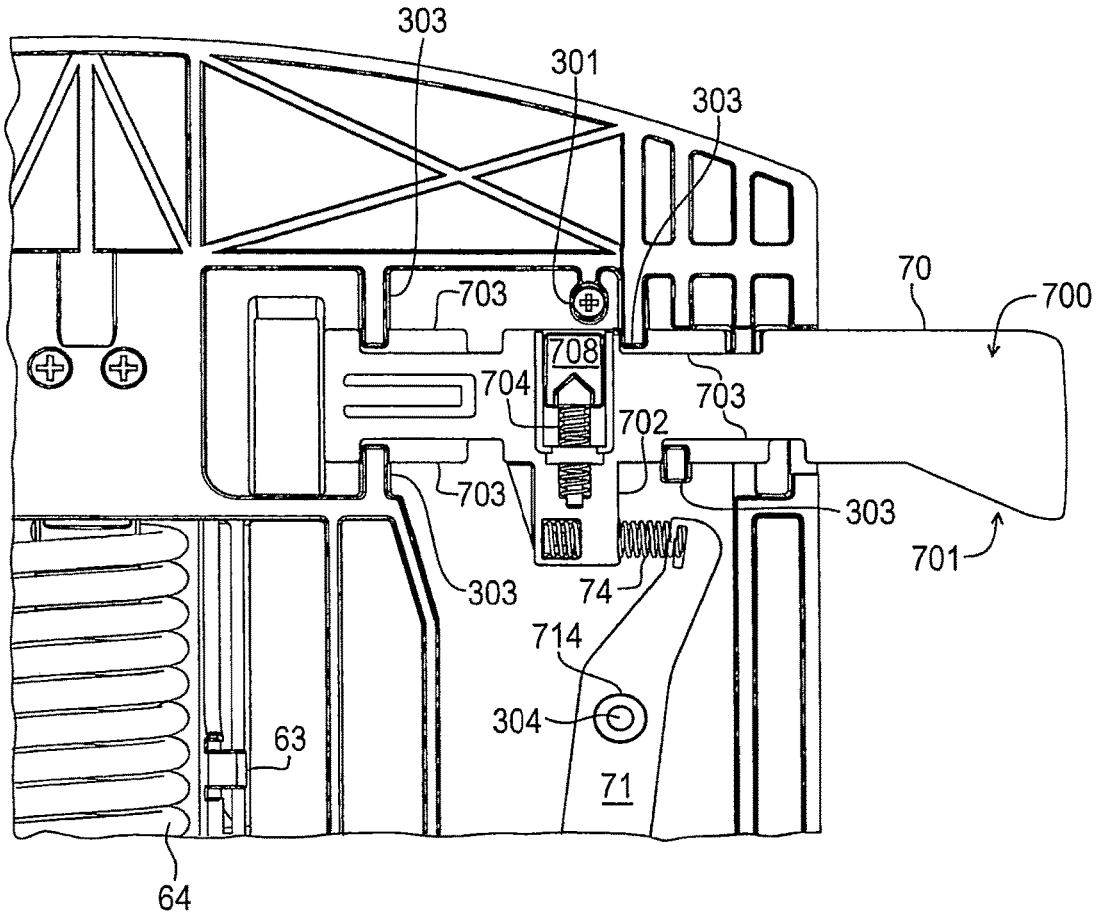
Figure 12E:
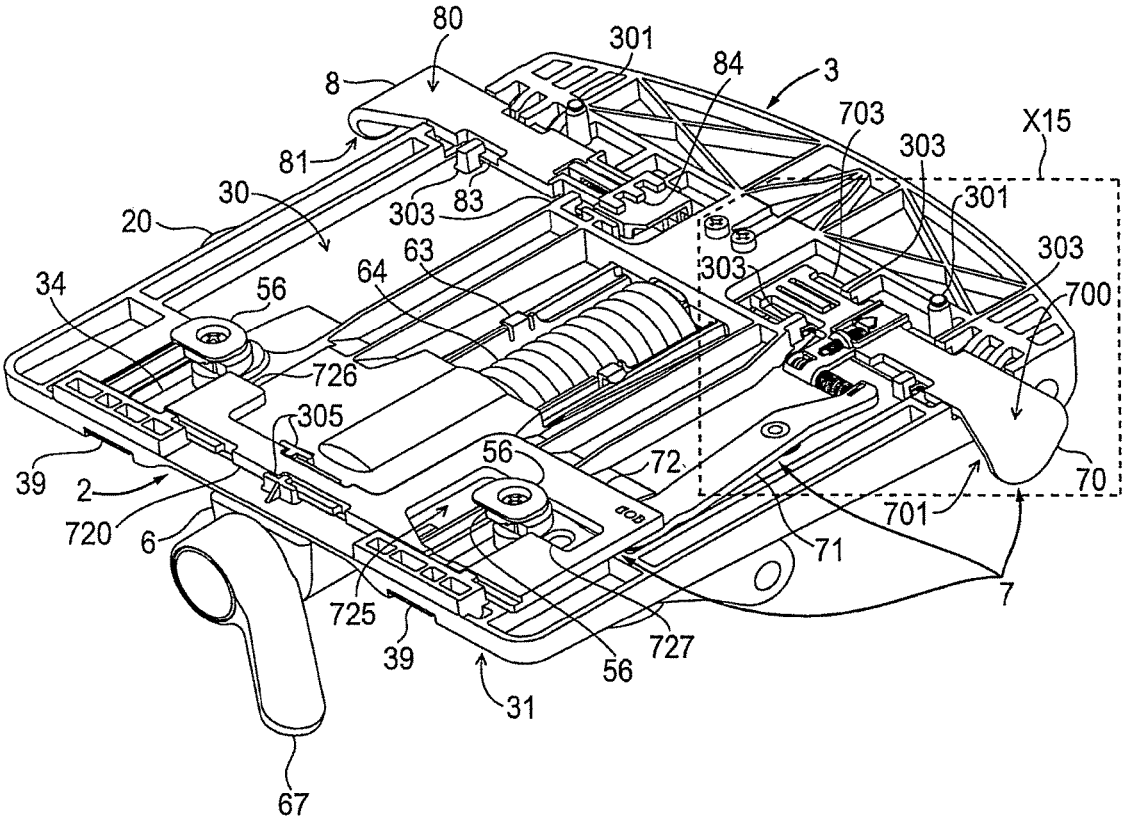
Figure 12F:
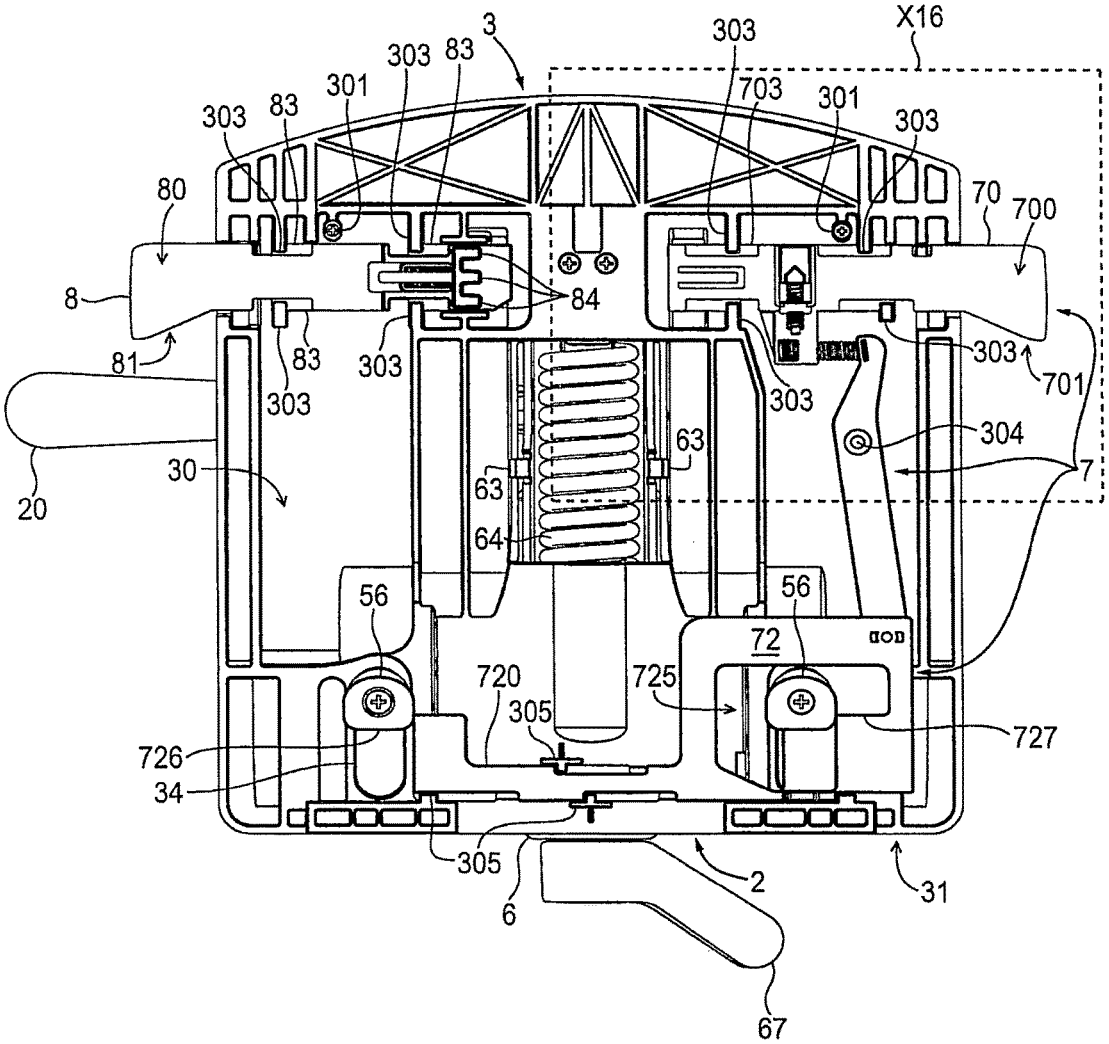
Figure 12G:
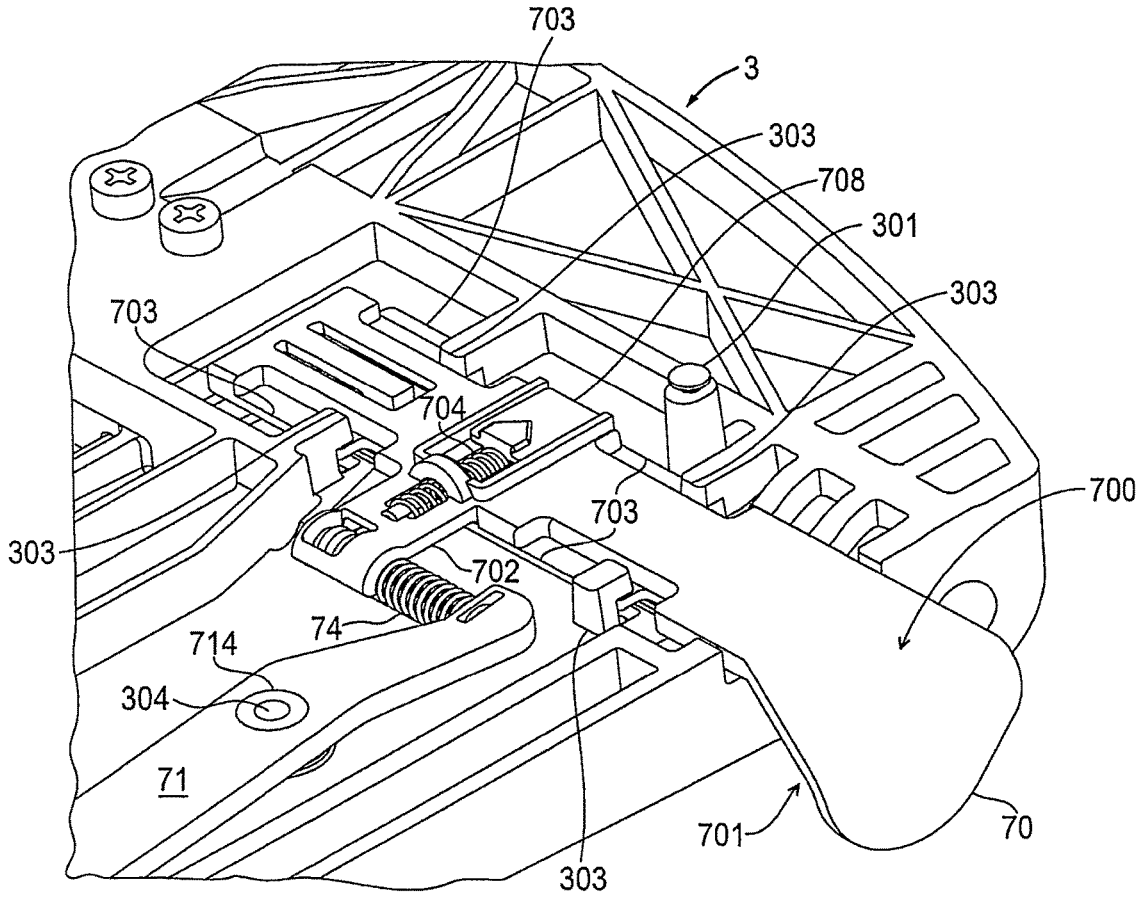
Figure 12H:
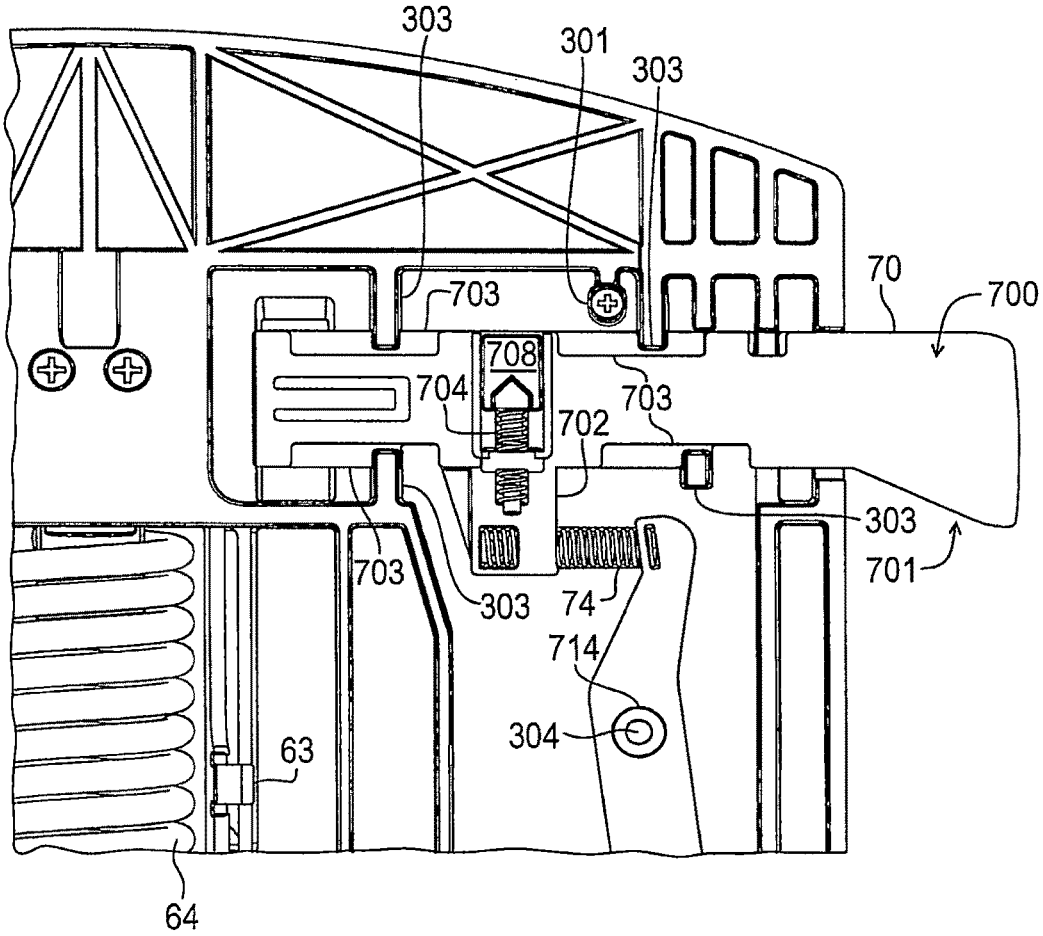

In the drawings:

FIG. 1A—shows the chair according to the invention, in the zero position, in a perspective front view;

FIG. 1B—shows the chair according to FIG. 1A, in a side view;

FIG. 1C—shows the chair according to FIG. 1A, in a perspective rear view;

FIG. 1D—shows the chair according to FIG. 1A, in a perspective view from below;

FIG. 1E—shows the chair according to FIG. 1A, without seat cushion, in a perspective front view;

FIG. 1F—shows the chair according to FIG. 1A, without seat cushion, in a perspective rear view;

FIG. 1G—shows the chair according to FIG. 1A, without seat cushion, in a perspective view from below;

FIG. 1H—shows the chair according to FIG. 1A, in the maximum inclined position, in a side view;

FIG. 2A—shows the main assemblies of the chair according to FIG. 1A, in a perspective exploded view, from above;

FIG. 2B—shows the representation according to FIG. 2A, in a perspective exploded view, from below;

FIG. 3A—shows the chair according to FIG. 1A, in a perspective exploded view, from above;

FIG. 3B—shows the representation according to FIG. 3A, in a perspective exploded view, from below;

FIG. 4A—shows the enlarged detail X1 according to FIG. 3A;

FIG. 4B—shows the enlarged detail X2 according to FIG. 3B;

FIG. 5A—shows the enlarged detail X3 according to FIG. 4A;

FIG. 5B—shows the enlarged detail X4 according to FIG. 4B;

FIG. 6A—shows the enlarged detail X5 according to FIG. 4A;

FIG. 6B—shows the enlarged detail X6 according to FIG. 4B;

FIG. 7A—shows the enlarged detail X7 according to FIG. 4A;

FIG. 7B—shows the enlarged detail X8 according to FIG. 4B;

FIG. 8A—shows the enlarged detail X9 according to FIG. 3A;

FIG. 8B—shows the enlarged detail X10 according to FIG. 3B;

FIG. 9A—shows the enlarged detail X11 according to FIG. 3A;

FIG. 9B—shows the enlarged detail X12 according to FIG. 3B;

FIGS. 10A to 10L: show the essential phases of the assembly of the chair according to FIG. 1A, as schematic representations;

FIG. 10A—first phase: provision of all individual parts, underframe and base plate on a reduced scale in relation to other chair parts, in a perspective exploded view, from above;

FIG. 10B—second phase: spring, hook and end piece according to FIG. 7A, assembled;

FIG. 10C—third phase: the assembly according to FIG. 10B inserted into the housing according to FIG. 7A and provided with spring adjuster;

FIG. 10D—fourth phase: the assembly according to FIG. 100, mounted on the carrier unit according to FIG. 6A;

FIG. 10E—fifth phase; the assembly comprising the base plate, actuator and depth-adjusting lever with the cover strip according to FIG. 5A moved closer;

FIG. 10F—sixth phase: the assembly according to FIG. 10E with inserted cover strip;

FIG. 10G—seventh phase: the assembly according to FIG. 10F positioned on the assembly according to FIG. 10D, with the back carrier, inserts, crown elements and bearing means brought closer;

FIG. 10H—eighth phase: the assembly according to FIG. 10G with fitted inserts bearing means and back carrier, docked on the carrier unit and the base plate;

FIG. 10J—shows the representation according to FIG. 10H, in a perspective view from above;

FIG. 10K—ninth phase: the assembly according to FIG. 10H with inserts inserted, backrest part and adjusting means brought closer, in a perspective view from the rear;

FIG. 10J—tenth phase: the assembly according to FIG. 10K, with the backrest part docked on the back carrier;

FIGS. 11A to 11F: show the operation of the actuator unit in characteristic positions, as schematic diagrams;

FIG. 11A—shows the chair body, actuator unit locked, back and seat inclination in the zero position, in a perspective plan view;

FIG. 11B—shows the representation according to FIG. 11A, in a side view;

FIG. 11C—shows the chair body according to FIG. 11A, actuator unit unlocked, back and seat inclination in the zero position, in a perspective plan view;

FIG. 11D—shows the representation according to FIG. 11C, in a changed perspective view;

FIG. 11E—shows the chair body, actuator unit un locked, back and seat inclination in the maximum inclined position, in a perspective plan view:

FIG. 11F—shows the representation according to FIG. 11E, in a side view;

FIGS. 12A to 12H: show the base plate, actuator unit and depth-adjusting lever according to FIG. 5A in a modified embodiment as well as the operation thereof in characteristic positions, as schematic diagrams;

FIG. 12A—shows the components according to FIG. 5A in a modified embodiment, in a perspective exploded view from above;

FIG. 12B—shows the enlarged detail X13 according to FIG. 12A;

FIG. 12C—shows the base plate according to FIG. 12A with fittings, actuator unit locked, in a plan view;

FIG. 12D—shows the enlarged detail X14 according to FIG. 12C;

FIG. 12E—shows the assembly according to FIG. 12C, actuator unit unlocked, in a perspective plan view;

FIG. 12F—shows the representation according to FIG. 12E, in a plan view;

FIG. 12G—shows the enlarged detail X15 according to FIG. 12E;

FIG. 12H—shows the enlarged detail X16 according to FIG. 12F;

FIG. 13—shows the chair body according to FIG. 11A, with fitted seat, seat depth in both end positions, in a side view; and FIG. 14—shows the chair body according to FIG. 11A, spring adjuster in both end positions, in a front view.

EXEMPLARY EMBODIMENT

With reference to the appended drawings a detailed description is given below of an exemplary embodiment of the chair according to the invention with individual components also in a modified design.

The following explanation applies to the entire further description. If reference numerals are included in one figure for the purpose of clarity of the depiction, but these reference numerals are not explained in the directly associated text of the description, reference is made to the passages where they are mentioned in preceding descriptions of the figures. In the interest of clarity it is generally unnecessary to repeat designation of components in subsequent figures, so long as it is clearly discernible in the figure that it involves "recurring" components.

FIGS. 1A to 1G

The chair with mutually synchronous deflection between the backrest 9 and the seat 25 consists substantially of the underframe 1 intended to be placed onto the floor, the mechanism 2 that rests thereon, causes synchronous deflection and supports the seat 25, and the backrest 9 articulated on the mechanism 2. At present the seat 25 and the backrest 9 are located in the zero position $R_0$, $S_0$, i.e. the seat 25 extends more or less horizontally, whilst the backrest 9 is positioned so that the backrest cushion 99 assumes an orientation that is synchronous with the seat 25 and is vertical in principle. The underframe 1 has a star-shaped foot 10—provided with a plurality of floor elements 14, for example rollers—from which a vertical tube 11, in which the height-adjusting gas spring 12 is received, extends centrally upwards. The height-adjusting gas spring 12 serves for variable height adjustment of the seat 25 according to the needs of the user by actuation of the height-adjusting lever 20. At the same time the height-adjusting gas spring 12 enables the seat 25 to rotate about a vertical axis V, as is usual for comfortable office chairs.

The two-armed, forked base support 50 is rigidly fastened, as a component of the mechanism 2, to the height-adjusting gas spring 12. By means of the spring adjuster 67 belonging to the mechanism 2, during the deflection of the seat 25 and the backrest 9, the resistance can be increased, starting from the zero position $R_0$,$S_0$, or the restoring force can be reduced towards the zero position $R_0$,$S_0$.

The stationary first axis of rotation D1 extends through the lower end of the base support 50, and the base support 50 the lower end of a back carrier 91, which is bent multiple times, of the backrest 9 is articulated on said first axis at each of the two outer flanks. From the first axis of rotation D1 the two lower ends of the back carrier 91 extend upwards, initially into a movable third axis of rotation D3, which extends transversely below the seat 25 and moves around the first axis of rotation D1 when the mechanism 2 is adjusted. A second stationary axis of rotation D2 extends at the front end of the base support 50, more or less below the seat 25. From the third axis of rotation D3 the back carrier 91 merges into a rest portion in order to form arm rests, and in a curved portion surrounds the backrest 9 at the rear. The back carrier 91 is provided centrally at the top with a connection 97, in order to fasten thereon the backrest plate 93 to which in turn the backrest cushion 99 is fixed. By actuation of the lever 950 the assembly consisting of the backrest plate 93 and the backrest cushion 99 can be locked in a freely selectable vertical position on the connection 97.

FIG. 1H

The seat 25 and the backrest 9 are now located in the maximum inclined position $R_{max}$,$S_{max}$, i.e. the seat 25 is lowered backwards towards the backrest 9. The backrest 9 is positioned so that the backrest cushion 99 provided thereon adopts an orientation that is now inclined towards the rear and synchronously with the seat 25.

FIGS. 2A to 4B

The main assemblies of the chair construction are:

a conventional underframe 1;

the mechanism 2 with the base plate 3, the carrier unit 5, the spring unit 6, the actuator unit 7, the height-adjusting lever 20, the depth-adjusting lever 8 and the base panel 4 as a component of the seat 25; and the backrest 9 with the back carrier 91, the connector 97 fastened thereon and the backrest part 92.

The base plate 3 has a top side 30 and an underside 31 and—in the assembled state—the rear hinge rod 98, which extends horizontally on the third axis of rotation D3 and on which the rear region of the base plate 3 is articulated, extends through the base plate more or less at the rear end thereof. At the front the base plate 3 lies displaceably on the base support 50. On both sides of the base plate 3 inserts 38 inserts are ready for fitting in the direction of extension of the third axis of rotation D3. Elongate cover strips 39 are positioned spaced-apart from the front end of the base plate 3, which are provided for insertion into recesses 309 created therefor. The top side 30 of the base plate 3 serves to receive the depth-adjusting lever 8 as well as the actuator unit 7 with the switching lever 70, connector 71 and slider 72.

The cushion 48 with the cover 49 is fastened to the base panel 4, wherein the base panel 4 is displaceably supported on the base plate 3 in the longitudinal direction—transversely with respect to the axis of rotation D3. The position of the base panel 4 on the base plate 3 is adjustable with the aid of the depth-adjusting lever 8, which is arranged alongside the base plate 3. The seat 25 is placed onto the base plate 3 and forms, with the base panel 4, a component secured by positive engagement. The spring unit 6 is arranged below the base plate 3 resting on the carrier unit 5. The actuator unit 7 consists of the switching lever 70, the connector 71 and the slider 72, by means of which the seat inclination $S_0$,$S_{max}$ or back inclination $R_0$,$R_{max}$ can be effected from a released position into a locked position and vice versa.

The backrest 9 is made up of the back carrier 91, through which the two axes of rotation D1 and D3 extend, and the connector 97 provided centrally at the upper end of the carrier 91, to which the backrest part 92 is fastened so as to be vertically adjustable. The back carrier 91 is a symmetrically shaped frame with multiple bends, and is preferably constructed as an integrally produced injection molded plastic part. The backrest part 92 consists of a backrest plate 93 and a backrest cushion 99 which is facing the back of a user. The chair with the backrest 9 also has the two armrests, which as portions of the carrier 91 extend on both sides from the backrest cushion 99 towards the third axis of rotation D3. The portion is structured in the support region, which projects upwards from the third axis of rotation D3, and in the principally horizontal contact region, which advances to the height of the backrest cushion 99. There is an arcuate transition between the support region and the contact region. The height-adjusting lever 20 serves for actuation of the height-adjusting gas spring 12, which is attached to the mechanism 2 by means of the pin 21 forming an axis of rotation.

FIGS. 5A and 5B

The substantially rectangular base plate 3 has an outer peripheral plate edge 36 on its top side 30. A notch 306 which interrupts the plate 36 is provided in each case along the two long sides close to the rear edge. The two notches 306 serve to receive the switching lever 70 or the depth-adjusting lever 8. Four guide pins 303, which are arranged in a rectangle and serve for positioning of the switching lever 70 and of the depth-adjusting lever 8, project from the top side 30 and axially with respect to the two notches 306. For embedding the spring 85 a U-shaped receptacle 302 is arranged between two guide pins 303 which are facing the depth-adjusting lever 8. An undulating anchor contour 308 is located on the top side 30 between two guide pins 303 facing the switching lever 70. Close to the rear plate edge 36 and in each case adjacent to the four guide pins 303 arranged in a rectangle, in each case a pin 301 projects from the top side 30 with a mushroom-shaped undercut—produced by a cap screw screwed into the pin 301 with a washer—which serves to guide the base panel 4. A bearing journal 304 likewise projecting from the top side 30 is intended to receive the connector 71. A pair of guide pieces 305 that are spaced apart from one another are positioned between the two recesses 309. Between the left opening 34 and the guide pieces 305 a hole 307 is provided which with the stop 417 (see FIG. 8B) forms a limit during the adjustment of the minimum seat depth $T_{min}$ when the base panel 4 is displaced on the base plate 3, so that the seat 25 cannot be moved too far to the rear and thus inadvertent release of the base plate 3 is avoided. In the center the base plate 3 has a rectangular cutout 33, onto which a pocket 32 opens. The base plate 3 has an elongate opening 34 in each case in the direction of extension of the two recesses 309. The two openings 34 are oriented at right angles to the transversely extending axes of rotation D1, D2, D3. On the underside 31 an extension 310, in which an axial recess 311 is provided, extends in each case from the rear plate edge 36 at the two outer corners and merges into the side flank of the base plate 3. The respective cover strip 39 has a central hole 390.

The elongate switching lever 70 has a top side 700 and an underside 701. On both long sides there are in each case two undercuts 703 that are spaced apart from one another, wherein in each case two undercuts 703 lie opposite one another. The undercuts 703 are complementary to the guide pins 303 and, in the assembled state, serve for positioning of the switching lever 70 on the base plate 3.

An extension 702, from which a projecting spike protrudes, extends from one long side. A centrally arranged hook 706 from one long side configured as a spring tab, which is cut out between longitudinal grooves, is provided at the opposite end to the gripping part of the switching lever 70. The strut-like connector 71 has at one end a first hole 710 which is opposite to a perforation at the other end. A second hole 714, into which the bearing journal 304 is inserted in the assembled state of the connector 71, is positioned between the first hole 710 and the perforation. The spike of the switching lever 70 is received in the perforation.

The flat slider 72 has an elongate arm part 720, from the front end of which a branch 724 extends with an outer buffer edge 726 provided thereon. Attached to the rear end of the arm part 720 is a plate part 723 with an inner cutout 725, from which a side part 728 extends at right angles, the front limit of said side part constituting the inner buffer edge 727. The two buffer edges 726, 727 are aligned with one another. On the outer edge of the plate part 723 a pin 721, which in the assembled state is inserted in the first hole 710 of the connector 71, extends from the underside of the slider 72.

The elongate switching lever 8 has a top side 80 and an underside 81. On both long sides there are in each case two undercuts 83 that are spaced apart from one another, wherein the undercuts 83 lie opposite one another in pairs. The undercuts 83 and the guide pins 303 co-operate in the assembled state, in order to position the depth-adjusting lever 8 on the base plate 3. A toothed counter-contour 84 is provided on the top side 80 at the end opposite the gripping part. On its underside 81 the depth-adjusting lever 8 has two webs 82 aligned with one another, which define the two end positions of the depth-adjusting lever 8 in co-operation with the receptacle 302.

FIGS. 6A and 6B

The carrier unit 5 is made up of the forked base support 50, the crown elements 56, the front hinge rod 57, the bushings 58 and the rollers 59. The base support 50 has a U-shaped central part 54, from which two arms 53 extend which are spaced apart from one another and spreading. A first axial hole 51 with the central first axis of rotation D1 extending therein, as well as the vertical axis V at right angles thereto, on which the underframe 1 is placed, extend through the central part 54. A second axial hole 52 extends close to the free end of each arm 53, wherein the second axial holes 52 lie on the second axis of rotation D2. An upwardly projecting shaped piece 55, which serves to receive the mushroom-like undercut crown element 56, extends in each case at the free ends of the arms 53. On the second axis of rotation D2 the front hinge rod 57 and a respective pair of bushings 58 and a respective roller 59 are ready for use.

FIGS. 7A and 7B

The spring unit 6 consists of the housing 60 in the form of a half-shell, which has the axial passage 61 in the center, the spring 64, the hook 65, the end piece 66, the spring adjuster 67, the eccentric 68 as well as the cover 69. In the assembled state of the spring unit 6, the spring 64 is gripped in the housing 60 between the end piece 66 and the hook 65, wherein the hook 65 extends through the axial passage 61 and is fixed in the eccentric 68. The eccentric 68 is in turn positioned between the spring adjuster 67 and the cover 69, in this case the eccentric 68 is guided on a curved path provided in the spring adjuster 67, so that the spring 64 is more or less tensioned depending upon the position of the spring adjuster 67. The second axial hole 62, through which the second axis of rotation D2 extends, extends through the housing 60 at right angles to the axial passage 61. On each upper edge the housing 60 has a fixing element 63, which lie opposite one another.

FIGS. 8A and 8B

The elongate switching lever 4 has a top side 40 and an underside 41. A grid of stiffening ribs 400 is provided along the top side 40. Two keyhole-shaped rear elongate holes 411, which are spaced apart from one another and which in each case have a is widened portion and are directed towards the rear edge, are provided close to the rear edge. Two front elongate holes 44, of which the widened portions are facing the front edge, lie in the direction of alignment with respect to the two rear elongate holes 411. On the underside 41 a pattern 414 for the seat height adjustment described later is provided, as well as the stop 417 and/or a stopper 416, which in each case secure the seat 25 against inadvertent release of the base plate 3.

The coating 49 that is usually made of material, a knitted fabric or leather as a cover for the cushion 48 is sewn to preferably a plurality of bracket-shaped cover strips 47, wherein the tabs 479 projecting on the cover strips 47 are cut out from the coating 49. During the assembly, the tabs 479 are clipped into the notches 419 provided on the underside 41 of the base panel 4.

FIGS. 9A and 9B

The back carrier 91 of the backrest 9 has a bushing 90 on each side for insertion of the rear hinge rod 98. The third axis of rotation D3 extends through the socket 90 and the rear hinge rod 98. An axial hole 910 is provided on the lower portion of each of the two free ends of the back carrier 91, the axial holes being aligned with one another and intended for the articulation on the first axis of rotation D1. Bearing means 96, which consist of a journal 960 as well as a bearing shell 961 and serve for the assembly of the backrest 9 on the carrier unit 5 as described later, are spaced apart from the respective axial hole 910 on the first axis of rotation D1. The backrest part 92 is made up of the backrest plate 93 and the backrest cushion 99. A recess 993, which is complementary to the backrest plate 93 and in which the backrest plate 93 is fixedly inserted, is provided on the rear of the backrest cushion 99. The backrest plate 93 has a central counterpart piece 94, that is connected to the connector 97 on the back carrier 91 so as to be vertically displaceable. The adjusting means 95 consisting of the lever 950, an axial pin 951, a washer 952 and the screw 953 is intended for fastening the backrest part 92 to the connector 97.

FIGS. 10A to 10L

This sequence of drawings illustrates the essential phases of the successive assembly of the mechanism 2 and the backrest 9 of the chair with the components associated therewith.

FIG. 10A (First Phase)

Initially all the individual parts required for the assembly of the chair are provided, such as the base plate 3, the carrier unit 5, the spring unit 6, the actuator unit 7, the depth-adjusting lever 8 and the backrest 9. The underframe 1 and the base panel 4 are illustrated on a smaller scale by comparison with the other components because of the limitation drawing space available.

FIG. 10B (Second Phase)

The spring 64 is attached with its first end to the hook 65, the interlinking part of which engages positively with the inside surface of the spring 64. The second end of the spring 64 is fitted on a lug belonging to the end piece 66 which has a grooved profiling that likewise engages positively with the inside surface of the spring 64.

FIG. 100 (Third Phase)

The spring adjuster 67 is aligned with the axial passage 61 of the housing 60, in order to introduce the eccentric 68 from the end nearest the spring adjuster 67 into the axial passage 61. The unit consisting of the spring 64 under tensile stress—in the form of a helical spring, the hook 65 and the end piece 66 is now inserted into the housing 60, wherein the hook 65 engages in a slot provided on the eccentric 68, and the end piece 66 terminates flush with the housing 60. The housing 60 has, at each of its two free upper edges extending parallel to one another, a respective outwardly projecting support element 63, these support elements being arranged opposite one another. In the state inserted into the base plate 3, the support elements 63 are attached to the top side 30 of the base plate 3 adjacent to the cutout 33. The mouth that is open at the front in the spring adjuster 67 is closed by the cover 69 that can be inserted therein.

FIG. 10D (Fourth Phase)

The spring unit 6 assembled up to this stage is positioned between the two arms 53 of the base support 50, so that the second axial holes 52 with the second axial holes 62 of the spring unit 6 are oriented with respect to one another on the second axis of rotation D2, in order to be inserted through the front hinge rod 57, which thus extends along the second axis of rotation D2. Beforehand the bushings 58 have been positioned on the outside and the inside of each arm 53 in the two axial holes 52 as bearing shells. Thus, the spring unit 6 is articulated on the stationary second axis of rotation D2. A roller 59 is fitted on each of the two outer ends of the front hinge rod 57 that project out of the associated second axial hole 52.

FIG. 10E (Fifth Phase)

During installation of the actuator unit 7 in the base plate 3, first of all the switching lever 70 is fitted on the top side 30 of the base plate 3, so that the undercuts 703 come to lie below the guide pins 303. The hook 706 on the switching lever 70 engages in the anchor contour 308 of the base plate 3 and serves for positioning of the switching lever 70 in its two end positions. Subsequently the connector 71 is inserted, so that its perforation is attached to the spike on the switching lever 70. At the same time the bearing journal 304 of the base plate 3 which forms a center of rotation for the connector 71 is seated in the second hole 714 of the connector 71. After insertion of the slider 72, the pin 721 thereof engages in the first hole 710 of the connector 71 and is docked there, and the arm part 720 of the slider 72 is located between the two guide pieces 305 of the base plate 3. When the depth-adjusting lever 8 is inserted, its undercut 83 come to lie below the guide pins 303, which are also present on both sides on the depth-adjusting lever 8. The spring 85 is located in the receptacle 302, wherein the front web 82 of the depth-adjusting lever 8 presses against the free end of the spring 85 and the rear web 82 in the rest position of the depth-adjusting lever 8 strikes against the transverse rib of the receptacle 302.

FIG. 10F (Sixth Phase)

The two cover strips 39 are pushed into the recesses 309 on the underside 31 of the base plate 3 and thus protect the user of the chair against inadvertent engagement in the openings 34.

FIG. 10G (Seventh Phase)

The base plate 3 is fitted onto the assembly consisting of the carrier unit 5 and the spring unit 6, wherein the shaped pieces 55 of the carrier unit 5 protrude into the apertures 34 of the base plate 3 and are guided therein. The crown elements 56 are not yet fitted on the shaped piece 55, but are initially positioned above the base plate 3. The two rollers 59 located on the second axis of rotation D2 rest in the roller tracks 319 which are recessed in the form of grooves in the underside 31 of the base plate 3 and in which the rollers 59 roll along and are guided when the backrest 9 and the seat 25 are adjusted synchronously.

The above assembly is brought closer to the back carrier 91 with the connector located thereon 97 and to the rear hinge rod 98 inserted in the bushings 90 present on both sides, so that the rear hinge rod 98 is aligned with the projections 310 on the rear edge of the base plate 3. Each extension 310 has a downwardly open axial recess 311, which is intended for overlapping attachment to the hinge rod 98. The two pairs of half shell-shaped inserts 38 as well as the bearing means 96 to be installed on the first axis of rotation D1 are provided for further assembly.

FIGS. 10H and 10J (Eighth Phase)

In each axial recess 311 a pair of inserts 38 are inserted, which surround the rear hinge rod 98 extending therethrough and secure it in the axial recesses 311. Thus, the base plate 3 and the back carrier 91 are connected to one another on the third axis of rotation D3. During fitting, the inserts 38 are first of all clipped in pairs onto the rear hinge rod 98. Then the hinge rod 98 with the inserts 38 attached thereto together with the axial recesses 311 are aligned with the third axis of rotation D3, so that the inserts 38 on the rear hinge rod 98 can be pushed laterally into the axial recesses 311.

The lower free ends of the back carrier 91 are articulated on the first axis of rotation D1 on the carrier unit 5 using the bearing means 96—journals 960 and bearing shells 961. The bearing shells 961 lie between the central part 54 of the carrier unit 5 and the respective end of the back carrier 91, and at the same time in each case a journal 960 protrudes from outside through the axial hole 910 and the interposed bearing shell 961 into the first axial hole 51.

FIG. 10 K (Ninth Phase)

In each case one of the two mushroom-like undercut crown elements 56 is fixed, for example screwed, onto the shaped pieces 55. In this case the crown elements 56 project over the width of the openings 34, thus form a hold-down device for the seat plate 3 and ensure the guiding of the shaped pieces 55 in the respective associated opening 34. The pins 301 projecting from the top side 30 of the base plate 3, together with the crown elements 56 during fitting of the seat 25 onto the base plate 3, in a position pushed to the rear are intended for passage through the widened portions of the elongate holes 44, 411 and, after advancing, overlap these elongate holes 44, 411.

The backrest part 92 with the backrest plate 93 fixedly inserted in in its depression 993 is provided. In this case the counterpart piece 94 present on the rear side of the backrest plate 93 is facing the connector 97 provided on the back carrier 91. The adjusting means 95 that are required for the connection between the counterpart piece 94 of the backrest part 92 and the connector 97 on the back carrier 91—consisting of the lever 950, the axial pin 951, the washer 952 and the screw 953—are provided.

Figure 10L:
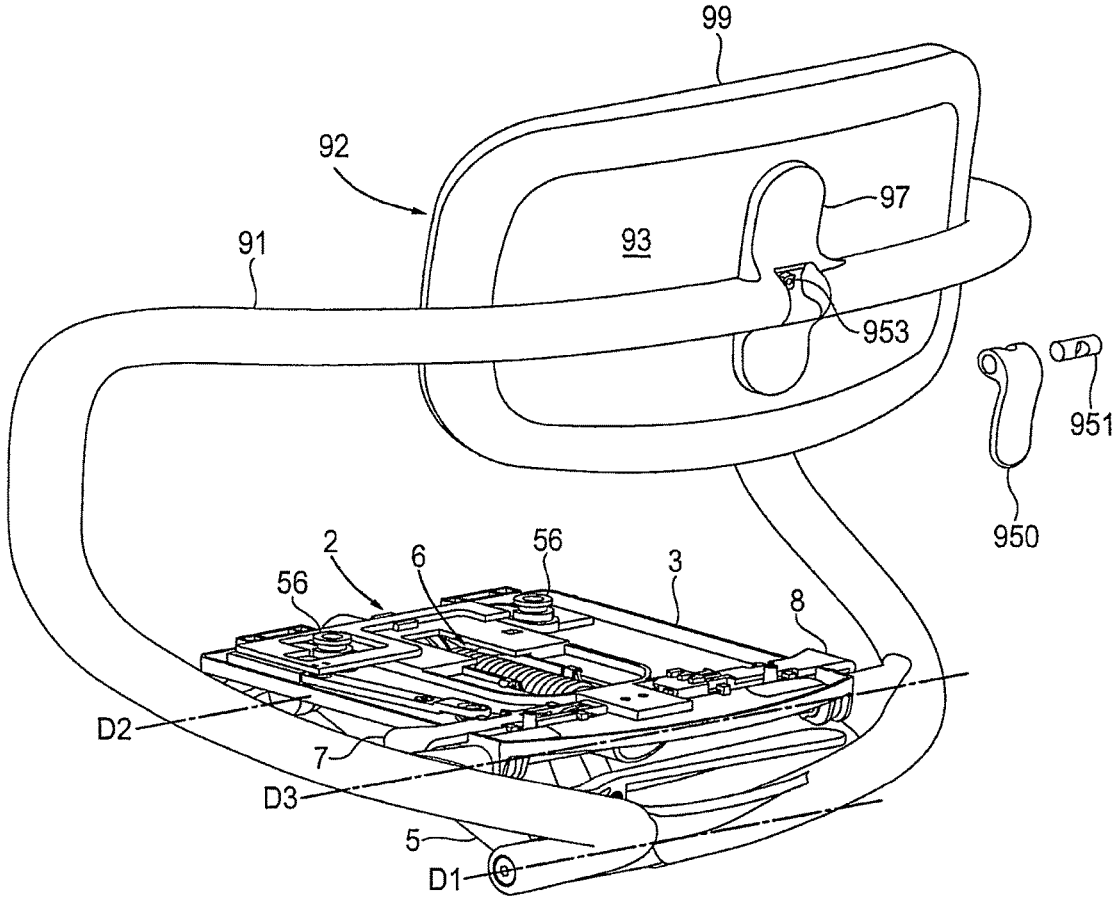

FIG. 10L (Ten Phase)

The washer 952 and the screw 953 are inserted into the counterpart piece 94, wherein the screw 953 projecting out of the rear side of the counterpart piece 94 engages in the connector 97 which surrounds the counterpart piece 94. The vertical position of the backrest part 92 can be adjusted by means of actuation of the lever 950 to be fitted, in which the axial pin 951 is inserted.

Drawings 11A to 11F

This series of drawings illustrates the movement sequences of the actuator unit 7 connected to the base plate 3, starting from the locked back and seat inclination in the zero position $R_0$,$S_0$, towards the unlocked back and seat inclination in the maximum inclined position $R_{max}$,$S_{max}$. The locked or freed state of the synchronous movement between the seat 25 and the backrest 9 depends upon the position of the slider 72 which can be moved by the switching lever 70 by means of the connector 71. The relative displacement of the stationary shaped pieces 55 with the fitted crown elements 56 in the moving openings 34 during a synchronous movement is impossible due to locking or is possible the event of unlocking.

FIGS. 11A and 11B

When the switching lever 70, that remains stable in this position, is pulled, deflection the slider 72 is moved in the opposite direction by means of the connector 71. Thus, its outer and inner buffer edges 726, 727 are present at the crown elements 56, and the displacement of the openings 34 in the base plate 3 against the stationary shaped pieces 55 with their crown elements 56 is blocked. The base plate 3 is located in the zero position of its seat inclination $S_0$ and the backrest bracket 91 is in the zero position of its back inclination $R_0$.

The inclination in the zero position of the base plate 3 and the inclination in the zero position of the backrest bracket 91 can be equated with the zero position of the back inclination $R_0$ and the zero position of the seat inclination $S_0$, wherein:

the backrest 9 is approximately vertical; and the seat 25 is located approximately horizontal (see FIG. 1A).

FIGS. 110 and 11D

With the switching lever 70 inserted—as second stable position—by means of the pivoting connector 71 the slider 72 is moved to the side and consequently its outer and inner buffer edges 726, 727 are moved away from the crown elements 56. A displacement of the openings 34 in the base plate 3 against the stationary shaped pieces 55 with their crown elements 56 mounted on top and a displacement of the cutout 725 in the slider 72 against the crown element 56 would be possible if the user were to exert a defined minimum pressure against the backrest 9. However, at present the base plate 3 is still located in the zero position of its seat inclination $S_0$ and the backrest bracket 91 is still in the zero position of its back inclination $R_0$.

FIGS. 11E and 11F

In the unlocked state of the actuator unit 7, as shown in FIGS. 11C and 11D, a defined minimum pressure has been exerted against the backrest 9 and the seat 25 together with the backrest 9 has been moved synchronously into the maximum seat inclination $S_{max}$ or back inclination $R_{max}$. Now a displacement of the openings 34 in the base plate 3 against the stationary shaped pieces 55 with their crown elements 56 mounted on top and a displacement of the cutout 725 in the slider 72 against the crown element 56 have taken place. The base plate 3 is located in the maximum position of its seat inclination $S_{max}$ and the backrest bracket 91 is in the maximum position of its back inclination $R_{max}$.

The inclination in the maximum position of the base plate 3 and the inclination in the maximum position of the backrest bracket 91 can be equated with the maximum position of the back inclination $R_{max}$ and the maximum position of the seat inclination $S_{max}$, wherein:

the backrest 9 stands obliquely backwards; and the seat 25 is lowered obliquely backwards (see FIG. 1H).

FIGS. 12A to 12H

In this series of drawings the actuator unit 7 and the base plate 3 are shown in a modified embodiment. In order to shorten the description, mention is only made below of the structural differences from the previous design. The depth-adjusting lever 8 is continuously located in the position where it is retracted by the spring 85 into the base plate 3, in which the currently selected setting of the seat depth is locked, since the counter-contour 84 of the depth-adjusting lever 8 is in engagement with the pattern 414 on the underside 41 of the base panel 4 is (see FIGS. 5A and 8B).

FIGS. 12A and 12B

The switching lever 70 has on the top side 700 a recess 705, which is open towards the rear, whilst towards the front it ends in a pocket. One end of a securing spring 704 is positioned in the pocket and the displaceable latching element 708 is fitted on the other axially movable end. On the top side 30 of the base plate 3 the anchor contour 308 in the form of a wedge-shaped cam is located before the latching element 708, wherein depending upon the position of the switching lever 70 the latching element 708 is positioned to the left or right of the anchor contour 308 and thus the binary switching function is stabilized. When the switching position is changed the anchor contour 308 is leapfrogged by the latching element 708 for changing sides.

Furthermore, one end of a transmission spring 74 is now fastened to the extension 702, and the other end of the spring is attached to the connector 71 leading to the connection to the slider 72. The slider 72 has guide contours 722 on both sides along its arm part 720. Guide contours 722 are also provided on the plate part 723. The branch 724 ends with the outer buffer edge 726, which is aligned with the inner buffer edge 727 on the side part 728 angled away from the cutout 725. The guide piece 305 positioned on the top side 30 of the base plate 3 engage around the guide contours 722. Thus, the slider 72 is guided on the base plate 3 and drifting of the slider 72 laterally or upwards with respect thereto is prevented.

FIGS. 12C and 12D

The switching lever 70 of the actuator unit 7 is located in the position in which it is pulled out from the base plate 3 to a limited extent and in which the slider 12 is moved to the left, into the position that blocks the synchronous movement, so that the buffer edges 726, 727 of the slider 72 are positioned at the crown elements 56, as in FIG. 11A. In this situation, the transmission spring 74 that is now present is compressed.

FIGS. 12E to 12H

The switching lever 70 of the actuator unit 7 is located in the in position in which it is inserted into the base plate 3 to a limited extent and in which the slider 12 has moved to the right, into the position that unblocks the synchronous movement, so that the buffer edges 726, 727 of the slider 72 are moved away from the crown elements 56 to the side, as in FIG. 110, The transmission spring 74 has pulled at the attached end of the connector 71.

The transmission spring 74 arranged between the switching lever 70 and the connector 71 forms a storage member during switching of the switching lever 70, specifically:

a) when switching to locking of the synchronous deflection of the backrest 9 and the seat 25 during a deflection of the backrest 9 out of the zero position of back inclination $R_0$ and seat inclination $S_0$ with corresponding inclination of the seat 25, wherein, as soon as the zero position of the back inclination $R_0$ and seat inclination $S_0$ is assumed, the energy stored by the switching in the transmission spring 74 moves the slider 72 into the locked position; and b) when switching to unlocking of the synchronous deflection of the backrest 9 and the seat 25 in a zero position of back inclination $R_0$ weight-loaded by the user, wherein as soon as the weight loading falls below a defined value in the zero position of the back inclination $R_0$, the energy stored by the switching in the transmission spring 74 moves the slider 72 into the unlocked position.

FIG. 13

If the counter-contour 84 is disengaged from the pattern 414 by limited pulling out of the depth-adjusting lever 8 against the action the spring 85, the seat 25 retained on the base plate 3 can be set in the so-called seat depth (T) between the furthest advanced position—designated as the maximum seat depth $T_{max}$—and the furthest pushed back position—designated as the minimum seat depth $T_{max}$—according to the user's requirements. If the depth-adjusting lever 8 is allowed to slide back again into the base plate 3, the newly selected setting is locked.

FIG. 14

With actuation of the spring adjuster 67 the hook 65 connected to the spring 64 is advanced more or less far towards the spring adjuster 67. Thus, the pretensioning of the spring 64 changes. A lower pretension is appropriate for users with low body weight, who can therefore press against the backrest 9 start the synchronous movement without exerting force. On the other hand, for users with a higher body weight a more intensive supporting by the mechanism 2 is required when the user leans against the backrest 9, so that then a suitably greater pretension should be set.

The invention claimed is:

1. A chair having a deflection that is mutually synchronous between a backrest and a seat over a range between respective zero positions of a back inclination and of a seat inclination and a respective maximum back inclination and a maximum seat inclination, comprising:

an underframe intended to be set on a floor;

a mechanism that causes the synchronous deflection with a spring unit arranged therein;

a carrier unit with a base support, which is rigidly fastened on the underframe and through which a stationary first axis of rotation and a stationary second axis of rotation extend;

a back support, which is articulated on the first axis of rotation and through which a third axis of rotation extends, which moves around the first axis of rotation when the mechanism is adjusted; and a base plate that is movably located above the base support at a front and is articulated on the third axis of rotation at a rear, wherein the base support is designed in the shape of a U, having a center part and two arms extending upward from the center part, with each arm having a shaped piece protruding upward, such that the shaped pieces each engage in an associated opening in the base plate, and when the mechanism is deflected, a relative displacement arises between the shaped pieces, which are stationary, and their respective associated openings, and wherein the openings are oriented in a direction of a seat depth and thus are at right angles to the first, second and third axes of rotation.

2. The chair according to claim 1, wherein a gas spring which is adjustable in height is arranged in a vertical tube in the underframe, and the base support supporting the mechanism that in turn supports the seat is fastened to the gas spring, in order thus to adjust the seat to a height that meets the needs of a user by means of actuation of a height-adjusting lever that activates the gas spring, and to make an assembly consisting of the seat and the backrest rotatable on the underframe about a vertical axis.

3. The chair according to claim 1, wherein the shaped pieces each have a crown element, which is undercut and projects over the width of the openings, and thus forms a hold-down device for the base plate and provides for guiding of the shaped pieces in their respective associated openings.

4. The chair according to claim 1, wherein on the second axis of rotation a roller, on which the base plate rolls during the synchronous deflection of the backrest and the seat, is arranged in each case on the outside of the two arms of the base support for the purpose of reducing friction;

the rollers are embedded in roller tracks recessed in a groove on an underside of the base plate, so that a guide is produced between the rollers and the base plate; and on the base plate recesses are positioned in a region of the openings and serve to receive cover strips, which close the openings from the underside of the base plate as a protection against jamming.

5. The chair according to claim 1, wherein the spring unit has a housing in which a helical spring under tensile stress is inserted and a first end of the helical spring is fixed;

the housing is articulated on the second axis of rotation; and a second end of the helical spring is anchored to the base plate.

6. The chair according to claim 5, wherein the housing of the spring unit is inserted into a cutout in the base plate;

the housing has a spring adjuster, to which the first end of the helical spring is attached, in order to select an intensity of the pretensioning of the helical spring when the spring adjuster is actuated; and the second end of the helical spring is fastened to an end piece that is retained in a pocket of the base plate.

7. The chair according to claim 1, wherein the back support is a symmetrically shaped frame with multiple bends;

an axial hole extends through each of two free ends of the back support, the axial holes being aligned with one another and configured for articulation on the first axis of rotation; and a horizontal rear hinge rod, on which a rear region of the base plate is articulated, extends on the third axis of rotation and is inserted into the back support upwards of the two free ends of the back support.

8. The chair according to claim 7, wherein the back support is provided centrally at a top with a connector that serves for fastening of a backrest part that is configured to be fixed in a selectable vertical position to the connector; and an extension is directed downwards from each side of the base plate and has a downwardly open axial recess, which is configured for overlapping attachment to the rear hinge rod; and shell-shaped inserts inserted into the axial recesses surround respective portions of the rear hinge rod extending therethrough and have a bearing function, and concurrently the inserts prevent inadvertent decoupling of the rear hinge rod from the extensions.

9. The chair according to claim 1, wherein an actuator unit is provided, by which the relative displacement of the shaped pieces in the openings can be blocked for locking of the respective zero positions of the back inclination and the seat inclination.

10. The chair according to claim 9, wherein the seat is a component placed onto the base plate and secured thereon by positive engagement, with a lower base panel that supports a cushion provided with a cover;

keyhole-shaped elongate holes, which extend in the direction of the seat depth and include a widened portion, are provided in the lower base panel;

lugs having a mushroom-shaped undercut project from a top side of the base plate, the lugs together with the crown elements are intended for passage through the widened portions of the elongate holes when the seat is placed onto the base plate, and after displacement of the seat in the direction of a maximum seat depth, in a finished fitted position, the lugs engage behind the elongate holes; and in a finally fitted position of the seat a stopper for the lower base panel strikes the base plate and thus secures the seat against inadvertent release of the base plate.

11. The chair according to claim 10, wherein a pattern is provided on an underside of the lower base panel; and a depth-adjusting lever is guided on the top side of the base plate and has a complementary counter-contour for interlinking with the pattern, wherein by actuation of the depth-adjusting lever interlinking between the pattern and the counter-contour can be temporarily released, in order to displace the seat mounted on the base plate to a selectable seat depth while the interlinking is in a released state.

12. The chair according to claim 9, wherein the actuator unit arranged on a top side of the base plate comprises a slider connected to a switching lever that blocks or unblocks the relative displacement of the shaped pieces in their respective associated openings depending upon a position of the slider.

13. The chair according to claim 12, wherein a connector that transmits the movement on the switching lever to the slider is arranged between the switching lever and the slider;

the slider comprises:

an arm part that, on one side, merges into an angled branch that ends with a buffer edge;

a plate part on the other side of the arm part, the plate part has an inner planar cutout from which the cutout extends into a side part; and guide contours along the arm part; wherein the buffer edge on the angled branch is at the same height as a buffer edge delimiting the side part on one side; and when the switching lever is positioned for locking of the synchronous deflection of the backrest and the seat out of the respective zero positions of the back inclination and the seat inclination, the buffer edges on the slider are configured to be positioned at the shaped pieces and thus to block the relative displacement thereof in their respective associated openings.

14. The chair according to claim 13, wherein the switching lever has a latching element fitted on a securing spring, and an anchor contour is arranged on the top side of the base plate, wherein in two end positions of the switching lever for locking or unlocking the synchronous deflection of the backrest and the seat the latching element comes into engagement with the anchor contour and thus a binary switching function is stabilized, a transmission spring is arranged between the switching lever and the connector and forms a storage member during switching of the switching lever, whereby:

when switching to locking of the synchronous deflection of the backrest and the seat during a deflection of the backrest out of the zero position of back inclination and seat inclination with corresponding inclination of the seat, wherein, as soon as the zero position of the back inclination and seat inclination is assumed, the energy stored by the switching in the transmission spring moves the slider into a locked position; and when switching to unlocking of the synchronous deflection of the backrest and the seat in a zero position of back inclination weight-loaded by the user, wherein as soon as the weight loading falls below a defined value in the zero position of the back inclination, the energy stored by the switching in the transmission spring moves the slider into an unlocked position.

15. The chair according to claim 13, wherein the guide contours provided on the slider along the arm part thereof cooperate by positive engagement with guide pieces provided on the top side of the base plate, in order to guide the slider securely along its movement path.

* * * * *